US008882189B2

(12) United States Patent
Voris

(10) Patent No.: US 8,882,189 B2
(45) Date of Patent: Nov. 11, 2014

(54) FOLDING FURNITURE

(75) Inventor: Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 178 days.

(21) Appl. No.: 13/455,960

(22) Filed: Apr. 25, 2012

(65) Prior Publication Data

US 2012/0267920 A1 Oct. 25, 2012

Related U.S. Application Data

(60) Provisional application No. 61/478,770, filed on Apr. 25, 2011.

(51) Int. Cl.
*A47C 4/04* (2006.01)

(52) U.S. Cl.
CPC ..... *A47C 4/045* (2013.01)
USPC ..... 297/59; 297/36

(58) Field of Classification Search
USPC ..... 297/6, 36, 59, 60
See application file for complete search history.

(56) References Cited

U.S. PATENT DOCUMENTS

| | | | | |
|---|---|---|---|---|
| 172,623 | A | | 1/1876 | Golightly |
| 195,545 | A | | 9/1877 | Sutherland |
| 250,343 | A | | 12/1881 | Cluff |
| 389,572 | A | | 9/1888 | Holden et al. |
| 417,819 | A | | 12/1889 | Gage |
| 444,992 | A | | 1/1891 | Pohl |
| 808,098 | A | | 12/1905 | Lewis |
| 933,624 | A | | 9/1909 | Chandler |
| 1,146,358 | A | * | 7/1915 | Slatter et al. ..... 297/335 |
| 1,158,212 | A | | 10/1915 | Henderson |
| 1,163,263 | A | * | 12/1915 | Rudduck ..... 297/36 |
| 1,262,110 | A | | 4/1918 | Slack |
| 1,419,947 | A | | 6/1922 | Schouten |
| 1,686,599 | A | * | 10/1928 | Corser et al. ..... 297/34 |
| 1,841,744 | A | | 1/1932 | Lawrence |
| 2,247,799 | A | | 7/1941 | Boardman |
| 2,312,602 | A | * | 3/1943 | Taylor ..... 297/6 |
| 620,711 | A | | 3/1949 | Hill |
| 2,555,566 | A | | 6/1951 | Bleck |
| 2,563,553 | A | | 8/1951 | Rosenjack |
| 663,478 | A | | 12/1951 | Russell |
| 2,752,218 | A | | 6/1956 | Shea, Sr. |
| 2,774,413 | A | | 12/1956 | Shepherdson |
| 2,849,054 | A | | 8/1958 | Shepherdson |
| 2,860,692 | A | | 11/1958 | Hamilton |
| 2,966,204 | A | | 12/1960 | Caravias |
| 2,978,012 | A | | 4/1961 | Norseen |

(Continued)

FOREIGN PATENT DOCUMENTS

| | | |
|---|---|---|
| JP | 2002165666 | 6/2002 |
| KR | 1020060114946 | 11/2006 |
| KR | 1020100111412 | 10/2010 |

OTHER PUBLICATIONS

International Search Report dated Nov. 28, 2012, for PCT/US2012/035016.

*Primary Examiner* — Peter Brown
(74) *Attorney, Agent, or Firm* — Barnes & Thornburg LLP

(57) ABSTRACT

A folding chair includes a frame, a seat bottom coupled to the frame, and legs for supporting the seat bottom in a horizontal position relative to the frame. The frame is formed to include a seat back.

4 Claims, 14 Drawing Sheets

(56) References Cited

U.S. PATENT DOCUMENTS

| | | | | |
|---|---|---|---|---|
| 3,021,175 | A | 2/1962 | Norquist | |
| 3,086,813 | A | 4/1963 | Best et al. | |
| 3,127,218 | A | 3/1964 | Banke | |
| 3,136,272 | A | 6/1964 | Sprigman | |
| 3,199,915 | A | 8/1965 | Hamilton et al. | |
| 3,709,167 | A | 1/1973 | Sprigman | |
| 4,052,087 | A | 10/1977 | Gagliardi | |
| 4,058,341 | A | 11/1977 | Prins | |
| 4,162,806 | A | 7/1979 | Cho | |
| 4,193,630 | A | 3/1980 | Steele | |
| 4,211,450 | A | 7/1980 | Sutter | |
| 4,218,089 | A | 8/1980 | Beltrami et al. | |
| 4,244,619 | A * | 1/1981 | Yoshimura | 297/34 |
| 4,253,203 | A | 3/1981 | Thomas | |
| 4,359,243 | A | 11/1982 | Crutcher | |
| 4,359,791 | A | 11/1982 | Thomas | |
| 4,475,256 | A | 10/1984 | Hatala | |
| 4,520,515 | A | 6/1985 | Hatala | |
| 4,685,725 | A | 8/1987 | Helfrich | |
| 5,096,259 | A | 3/1992 | Stanfield | |
| 5,170,519 | A | 12/1992 | Meade | |
| 5,253,921 | A | 10/1993 | Boulet | |
| 5,335,377 | A | 8/1994 | Masyada et al. | |
| 5,499,857 | A | 3/1996 | Lynch, Jr. | |
| 5,718,473 | A | 2/1998 | Lynch, Jr. | |
| 5,911,469 | A | 6/1999 | Young | |
| 6,015,185 | A | 1/2000 | Buono | |
| 6,056,353 | A | 5/2000 | Meara | |
| 6,099,073 | A | 8/2000 | Bruschi | |
| 6,135,557 | A | 10/2000 | Gustafsson | |
| 6,244,657 | B1 | 6/2001 | Momose | |
| 6,257,660 | B1 | 7/2001 | Calvey | |
| 6,270,156 | B1 | 8/2001 | Metzger et al. | |
| 6,543,842 | B2 | 4/2003 | Haney | |
| 6,682,138 | B2 | 1/2004 | Adams et al. | |
| 6,863,341 | B1 | 3/2005 | Wen | |
| 6,871,906 | B2 | 3/2005 | Haney | |
| 6,874,850 | B2 | 4/2005 | Berkowicz | |
| 6,953,221 | B1 | 10/2005 | Tseng et al. | |
| 6,981,741 | B2 | 1/2006 | Sirjoo | |
| 6,997,115 | B2 * | 2/2006 | Lockwood et al. | 108/115 |
| 7,014,261 | B2 | 3/2006 | Haney | |
| 7,021,705 | B1 | 4/2006 | Niermeyer et al. | |
| 7,401,850 | B2 | 7/2008 | Micheel | |
| 7,429,084 | B2 | 9/2008 | Diedrich | |
| 7,549,702 | B2 | 6/2009 | Meyers | |

* cited by examiner

FOLDING FURNITURE

PRIORITY CLAIM

This application claims priority under 35 U.S.C. §119(e) to U.S. Provisional Application Ser. No. 61/478,770, filed Apr. 25, 2012, which is expressly incorporated by reference herein.

BACKGROUND

The present disclosure relates to furniture, and in particular, to folding furniture. More particularly, the present disclosure relates to a folding chair and a folding bench.

SUMMARY

A folding chair in accordance with the present disclosure includes a frame, a seat bottom, and a seat-bottom support. The seat bottom is movable relative to the frame between an unfolded use position and a compact folded storage position.

In illustrative embodiments, the seat-bottom support is retractable and includes first and second gatefold leg units. The first gatefold leg unit is coupled to one side of the frame using a first hinge included in the folding chair. The second gatefold leg unit is coupled to an opposite side of the frame using a second hinge included in the folding chair. When the gatefold leg units are unfolded, they underlie and support the seat bottom in its unfolded use position.

In illustrative embodiments, seat-bottom retainers are coupled to each of the first and second gatefold leg units and are configured to guide the seat bottom as the seat moves downwardly into the unfolded use position and retain the seat bottom in the extended use position. A first seat-bottom retainer provides lock means for interconnecting one side of the seat bottom to the first gatefold leg unit to cause movement of the seat bottom to be blocked in response to engagement of the lock means by a user in the field. A second seat-bottom retainer provides lock means for interconnecting an opposite side of the seat bottom to the second gatefold leg unit to cause movement of the seat bottom to be blocked in response to engagement of the lock means by a user in the field.

In illustrative embodiments, the first seat-bottom retainer also provides alignment means for aligning the seat bottom on the first gatefold leg unit to cause the lock means to be arranged so that a user may engage the lock means to block movement of the seat bottom away from the unfolded use position. The second seat-bottom retainer provides alignment means for aligning the seat bottom on the second gatefold leg unit to cause the lock means to be arranged so that a user may engage the lock means to block movement of the seat bottom away from the unfolded use position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 2 is a perspective view similar to FIG. 1 showing upward pivoting movement of the foldable seat bottom about a horizontal pivot axis toward a seat back mounted on a frame included in the folding chair and inward pivoting movement of a foldable first gatefold leg unit about a first vertical pivot axis through a 90° angle in a clockwise direction from an extended position shown in FIG. 1 at a right angle to the frame to a retracted position alongside the seat bottom;

FIG. 3 is a perspective view similar to FIGS. 1 and 2 showing inward pivoting movement of a foldable second gatefold leg unit about a second vertical pivot axis through a 90° angle in a counterclockwise direction from the extended position shown in FIGS. 1 and 2 to the retracted position alongside the already-retracted first gatefold leg unit;

FIGS. 12-14 illustrate a folding sequence showing movement of a foldable seat bottom from an unfolded use position shown in FIG. 12 to a compact folded storage position shown in FIG. 14;

FIG. 13 is a perspective view similar to FIG. 12 showing upward pivoting movement of the foldable seat bottom about a horizontal pivot axis toward a seat back mounted on a frame included in the folding bench and inward pivoting movement of a foldable first gatefold leg unit about a first vertical pivot axis through a 90° angle in a clockwise direction from an extended position shown in FIG. 12 at a right angle to the frame to a retracted position alongside the seat bottom;

FIG. 14 is a perspective view similar to FIGS. 12 and 13 showing inward pivoting movement of a foldable second gatefold leg unit about a second vertical pivot axis through a 90° angle in a counterclockwise direction from the extended position shown in FIGS. 12 and 13 to the retracted position alongside the already-retracted first gatefold leg unit;

DETAILED DESCRIPTION

Figure 1:
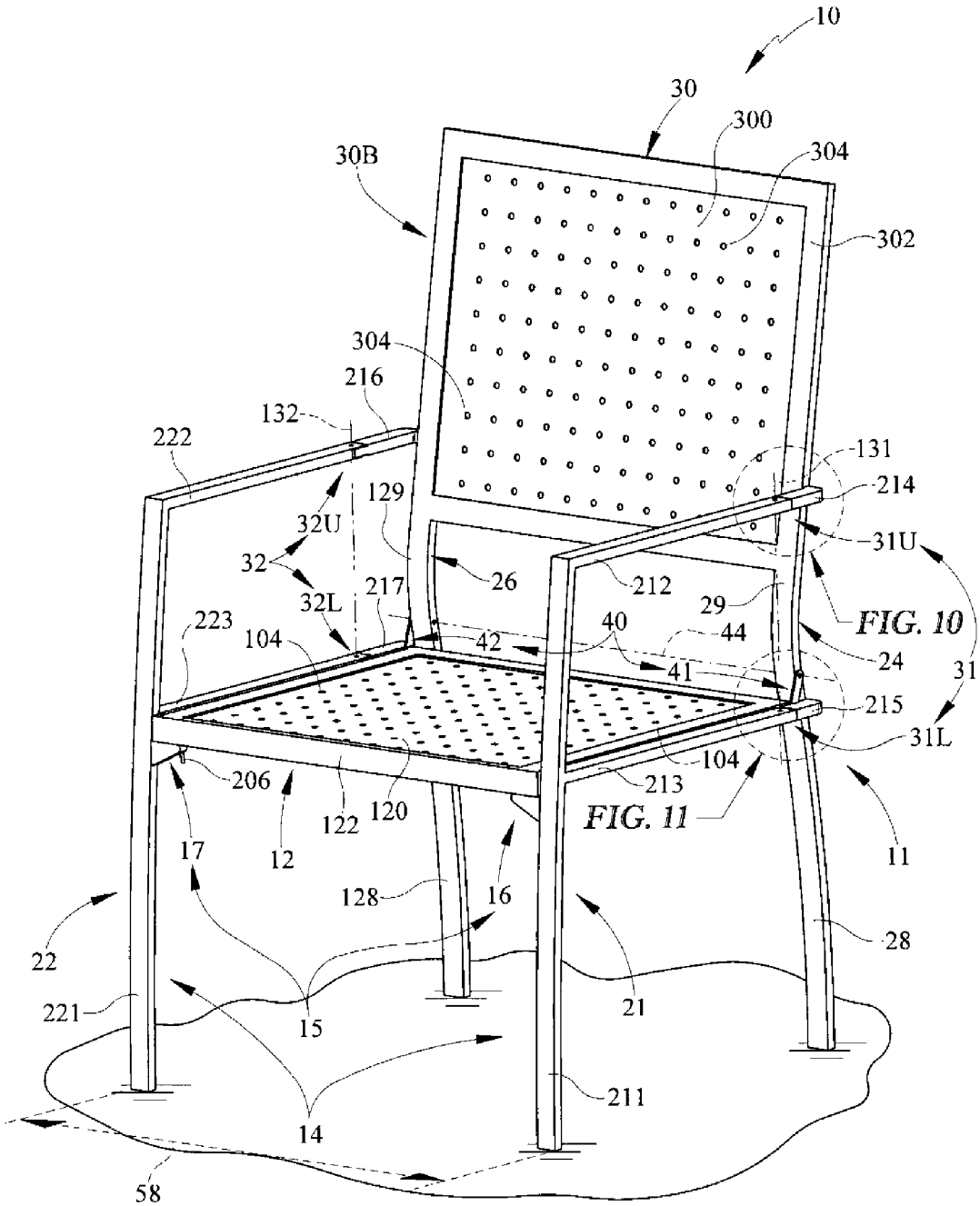
FIG. 1 is a perspective view of a folding chair in accordance with the present disclosure.
Figure 3:
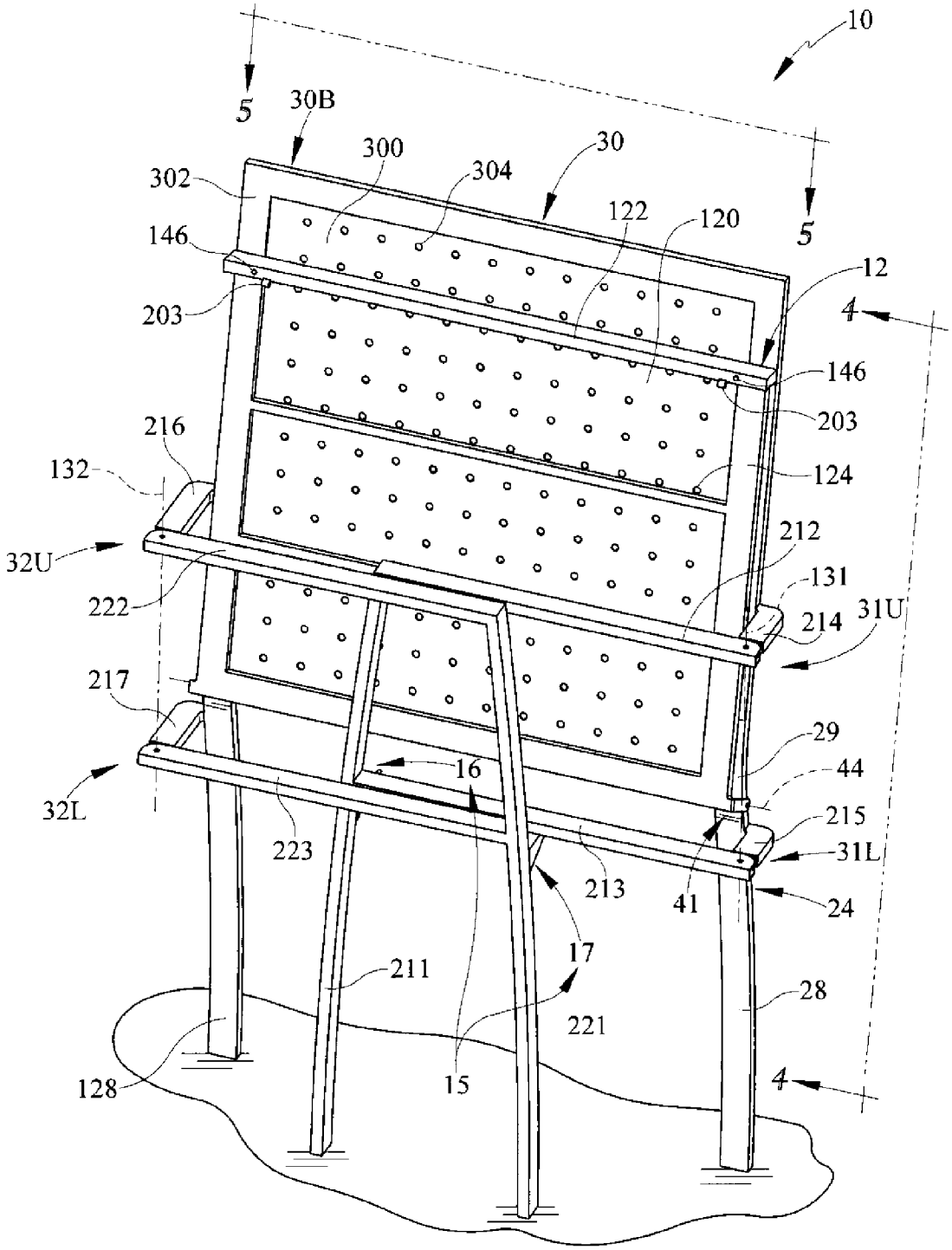
Figure 7:
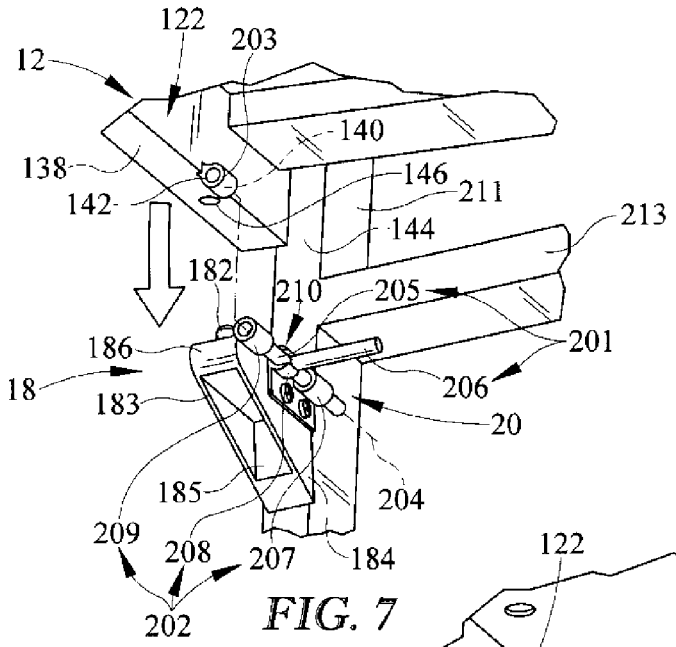
FIG. 7 is an enlarged partial perspective view suggesting coupling of the seat bottom to the first gatefold leg unit through a first seat-bottom retainer that first guides the seat bottom into the unfolded use position and second couples the seat bottom to the first gatefold leg unit to block unintended movement of the seat bottom away from the unfolded use position.
Figure 8:
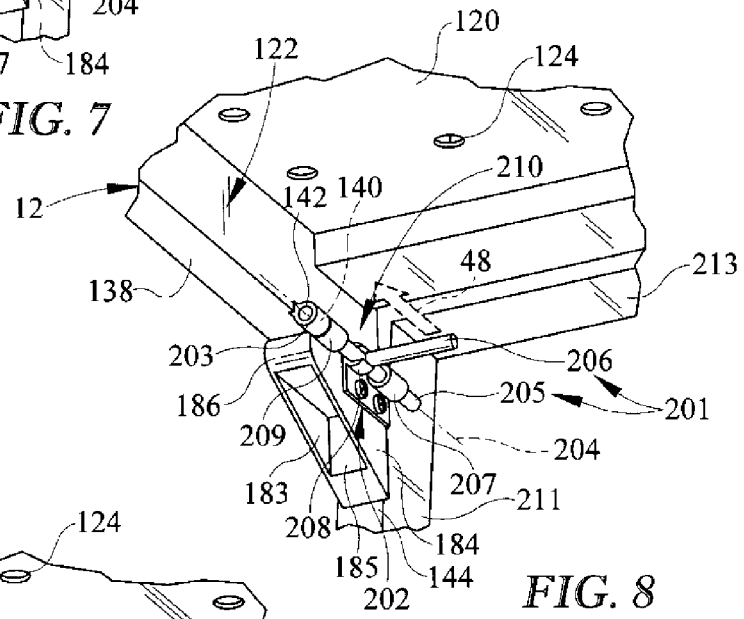
FIG. 8 is a view similar to FIG. 7 showing the seat bottom resting on a seat-bottom support brace and suggesting movement of a locking pin from an unlocked position shown in FIG. 7 toward a locked position in which the locking pin moves into a pin receiver coupled to the seat bottom to interconnect the first gatefold leg unit and the seat bottom as suggested in FIG. 9.
Figure 9:
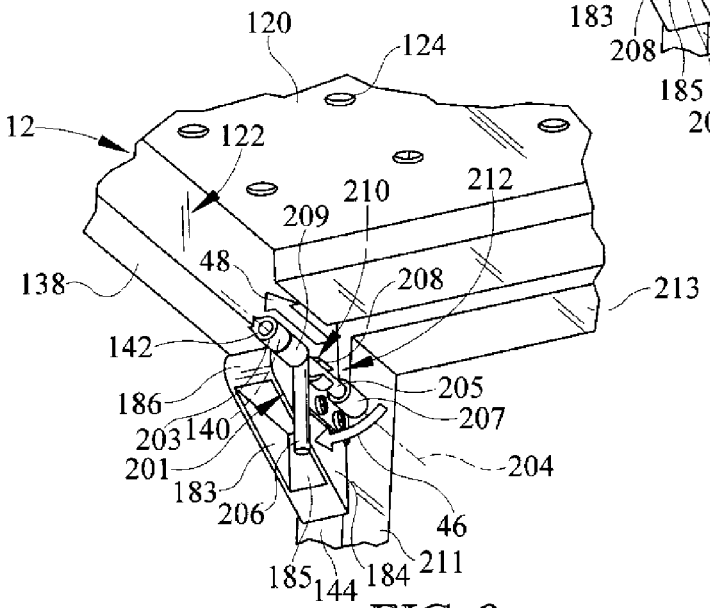
FIG. 9 is a view similar to FIG. 8 showing the locking pin in the locked position mated with the pin receiver.

A folding chair 10 in accordance with the present disclosure is shown in an unfolded use position in FIG. 1 and in a compact folded storage position in FIG. 3. A folding bench 510 in accordance with the present disclosure is another wider embodiment of folding chair 10 and is shown in the unfolded use position in FIG. 12 and in the compact folded storage position in FIG. 14. A seat-bottom retainer 16 included in folding chair 10 and folding bench 510 is used to couple a foldable seat bottom 12 (or 512) to foldable first and second gatefold leg units 21, 22 so that unintended movement of the seat bottom away from gatefold leg units 21, 22 is blocked. Illustrative use of seat-bottom retainer 16 is illustrated in FIGS. 7-9.

Folding chair 10 can be folded as suggested in FIGS. 1-5. Folding chair 10 includes a frame 11 and a foldable seat bottom 12 mounted for movement relative to frame 11 between an unfolded use position shown in FIG. 1 and a compact folded storage position shown in FIGS. 3-5. Foldable seat bottom 12 is supported by a retractable seat-bottom support 14 comprising foldable first and second gatefold leg units 21, 22 when folding chair 10 is erected as suggested in FIGS. 1 and 6. Seat bottom 12 is coupled to first and second gatefold leg units 21, 22 by an anchor means 15 comprising first and second seat-bottom retainers 16, 17 so that seat bottom 12 is retained in the unfolded use position.

Folding chair 10 includes a frame 11, a foldable seat bottom 12, and a retractable seat-bottom support 14 as shown, for example, in FIGS. 1-3 and 6. Folding bench 510 also includes a frame 11, a foldable seat bottom 512, and a retractable seat-bottom support 14 as shown, for example, in FIGS. 12-17 and described herein.

Figure 2:
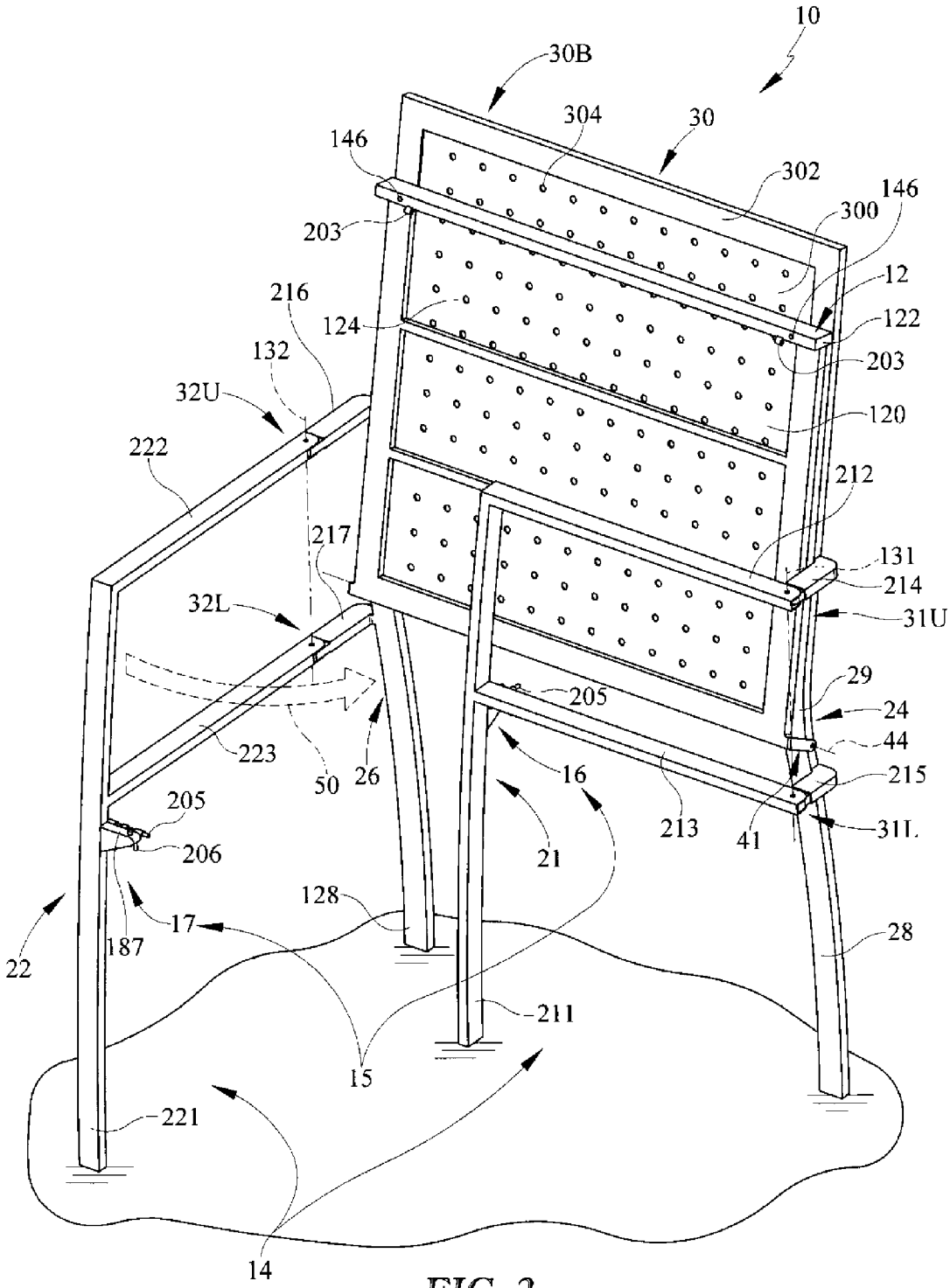
FIGS. 2-3 illustrate a folding sequence showing movement of a foldable seat bottom from an unfolded use position shown in FIG. 1 to a compact folded storage position shown in FIG. 3.

Frame 11 includes a backrest 30B comprising a seat back 30 and first and second back-support arms 29, 129 as suggested in FIG. 1. Frame 11 also includes first and second rear legs 28, 128 coupled to backrest 30B and arranged to elevate backrest 30B above ground under backrest 30B as suggested in FIG. 1. Foldable seat bottom 12 is mounted on frame 11 for pivotable movement relative to frame 11 about a horizontal pivot axis 44 between a compact folded storage position alongside backrest 30B (as shown in FIG. 2) and an unfolded use position arranged to extend along a generally horizontal plane away from frame 11 (as shown in FIG. 1). Backrest 30B is arranged to extend upwardly away from a rear edge of the foldable seat bottom 12 as shown in FIG. 1. Folding bench 512 includes a backrest 530B as suggested in FIGS. 12 and 13.

Retractable seat-bottom support 14 is configured to provide means for supporting foldable seat bottom 12 in the unfolded use position as suggested in FIG. 1. Retractable seat-bottom support 14 includes first and second gatefold leg units 21, 22 and anchor means 15 for selectively coupling foldable seat bottom 12 in a stationary position on seat-bottom support 14 after pivotable movement of first and second gatefold leg units 21, 22 to the extended positions and pivotable movement of foldable seat bottom 12 to the unfolded use position as suggested in FIGS. 1-3.

First gatefold leg unit 21 is mounted on frame 11 for pivotable movement about a first vertical axis 131 between a retracted position alongside frame 11 as shown in FIG. 2 and an extended position arranged to lie under and support a first side of foldable seat bottom 12 upon movement of foldable seat bottom 12 to the unfolded use position as shown in FIG. 1. First gatefold leg unit 21 is F-shaped in an illustrative embodiment as suggested in FIG. 6.

Second gatefold leg unit 22 is mounted on frame 11 for pivotable movement about a second vertical axis 132 between a retracted position alongside frame 11 as shown in FIG. 3 and an extended position arranged to lie under and support an opposite second side of foldable seat bottom 12 upon movement of foldable seat bottom 12 to the unfolded use position as shown in FIG. 1. Second gatefold unit 22 is F-shaped in an illustrative embodiment as suggested in FIG. 6.

The anchor means 15 comprises a first seat-bottom retainer 16 including a first seat-bottom support brace 18 coupled to first gatefold leg unit 21 to move therewith and arranged to engage and support foldable seat bottom 12 in the unfolded use position and a first seat-bottom lock 20 as suggested in FIGS. 1-3 and 6. The anchor means 15 also includes a second seat-bottom retainer 17 as suggested in FIGS. 1 and 6.

First seat-bottom lock 20 includes a locking-pin receiver 203, a locking-pin carrier 202, and a locking pin 201 as suggested in FIGS. 6-9. Locking-pin receiver 203 is coupled to foldable seat bottom 12 for movement therewith. Locking-pin carrier 202 is coupled to first gatefold leg unit 21 for movement therewith and formed to include a carrier passageway that is aligned as shown in FIGS. 8 and 9 to communicate with a receiver passageway formed in locking-pin receiver 203 upon movement of first gatefold leg unit 21 to the extended position and movement of foldable seat bottom 12 to the unfolded use position. Locking pin 201 is mounted for sliding movement in the carrier passageway between a withdrawn position (see FIG. 7) located outside of the receiver passageway formed in locking-pin receiver 203 to establish an unlocked condition of first seat-bottom retainer 16 to free foldable seat bottom 12 for movement relative to first gatefold leg unit 21 and an inserted position (see FIGS. 8 and 9) arranged to extend into the receiver passageway formed in locking-pin receiver 203 to establish a locked condition of first seat-bottom retainer 16 to block movement of foldable seat bottom 12 relative to first gatefold leg unit 21 and toward the compact folded storage position alongside backrest 30B.

The anchor means 15 further comprises a second seat-bottom retainer 17 including a second seat-bottom support brace 18 coupled to second gatefold leg unit 22 to move therewith and arranged to engage and support foldable seat bottom 12 in the unfolded use position and a second seat-bottom lock 20. The structure of second seat-bottom retainer 17 is similar to the structure of first seat-bottom retainer 16.

Second seat-bottom lock 20 includes a second locking-pin receiver 203, a locking-pin carrier 202, and a locking pin 201.

Locking-pin receiver 203 is coupled to foldable seat bottom 12 for movement therewith. Locking-pin carrier 202 is coupled to second gatefold leg unit 22 for movement therewith and formed to include a second carrier passageway that is aligned to communicate with a second receiver passageway formed in second locking-pin receiver 203 upon movement of second gatefold leg unit 22 to the extended position and movement of foldable seat bottom 12 to the unfolded use position. Second locking pin 201 is mounted for sliding movement in the second carrier passageway between a withdrawn position located outside of the second receiver passageway formed in second locking-pin receiver 203 to establish an unlocked condition of second seat-bottom retainer 17 to free foldable seat bottom 12 for movement relative to second gatefold leg unit 22 and an inserted position arranged to extend into the second receiver passageway formed in second locking-pin receiver 203 to establish a locked condition of second seat-bottom retainer 17 to block movement of foldable seat bottom 12 relative to second gatefold leg unit 22 and toward the compact folded storage position alongside backrest 30B.

Locking-pin carrier 202 includes a first guide ring 207 coupled to first seat-bottom support brace 18 and a second guide ring 209 coupled to first seat-bottom support brace 18 to lie in spaced-apart relation to first guide ring 207 to define an axle-mover space 210 therebetween as suggested in FIGS. 7-9. Locking pin 201 includes an axle 205 mounted for back-and-forth sliding movement in the carrier passageway formed in first and second guide rings 207, 209 to extend into the receiver passageway upon movement of locking pin 201 to the inserted position and to lie outside of the receiver passageway upon movement of locking pin 201 to the withdrawn position. Locking pin 201 further includes an axle mover 206 coupled to axle 205 and arranged to extend away therefrom. Axle mover 206 is arranged to move back and forth in axle-mover space 210 defined between first and second guide rings 207, 209 during movement of locking pin 201 between the inserted and withdrawn positions.

Locking-pin carrier 202 further includes a center guide brace 208 arranged to lie in axle-mover space 210 and coupled to first seat-bottom support brace 18 to lie in a stationary position in axle-mover space 210 between first and second guide rings 207, 209 as suggested in FIGS. 7-9. Center guide brace 208 is formed to include a mover-receiver slot 212 as shown in FIG. 9. Axle mover 206 is arranged to lie in mover-receiver slot 212 and extend outwardly away from first seat-bottom support brace 18 at about a three o'clock position upon movement of locking pin 201 to the withdrawn position owing to support provided by a portion of center guide brace 208 arranged to lie under axle mover 206. Axle mover 206 is arranged to lie in a space provided between first guide ring 207 and center guide brace 208 and extend downwardly away from foldable seat bottom 12 at about a six o'clock position upon movement of locking pin 201 to the inserted position.

First seat-bottom support brace 18 includes a horizontal top wall 187 arranged to lie under and face toward foldable seat bottom 12 upon movement of first gatefold leg unit 21 to the extended position and movement of foldable seat bottom 12 to the unfolded use position and a vertical side wall 184 arranged to extend downwardly from horizontal top wall 187 and locking-pin carrier 203 is coupled to vertical side wall 184 as suggested in FIGS. 6-9. First seat bottom support brace 18 further includes an upright locating pin 182 coupled to top wall 187 and arranged to extend upwardly into a locating-pin aperture 146 formed in foldable seat bottom 12 upon movement of first gatefold leg unit 21 to the extended position and movement of foldable seat bottom 12 to the unfolded use position to provide means for aligning the receiver passageway formed in locking-pin receiver 203 coupled to foldable seat bottom 12 with the carrier passageway formed in locking-pin carrier 202 when foldable seat bottom 12 arrives at the unfolded use position and first gatefold leg unit 21 arrives at the extended position so that locking pin 201 can be moved to the inserted position to extend into the receiver passageway.

Foldable seat bottom 12 is configured to provide (as shown in the embodiment of FIGS. 12-17) bench means for seating two people in side-by-side relation between first and second gate-fold leg units 21, 22 upon movement of first and second gate-fold leg units 21, 22 to the extended positions and movement of foldable seat bottom 512 to the unfolded use position. Foldable bench 510 is a wider version of foldable chair 12 in accordance with the present disclosure.

Frame 11 includes first and second upright posts 24, 26 as shown in FIG. 1. In an illustrative embodiment, first upright post 24 includes a rear leg 28 and a back-support arm 29 coupled to rear leg 28 and to a seat back 30 included in folding chair 10. Second upright post 26 includes a rear leg 128 and a back-support arm 129 coupled to rear leg 128 and to seat back 30. Seat back 30 is arranged to interconnect and extend between back-support arms 29 and 129 as shown in FIGS. 1 and 6.

Figure 4:
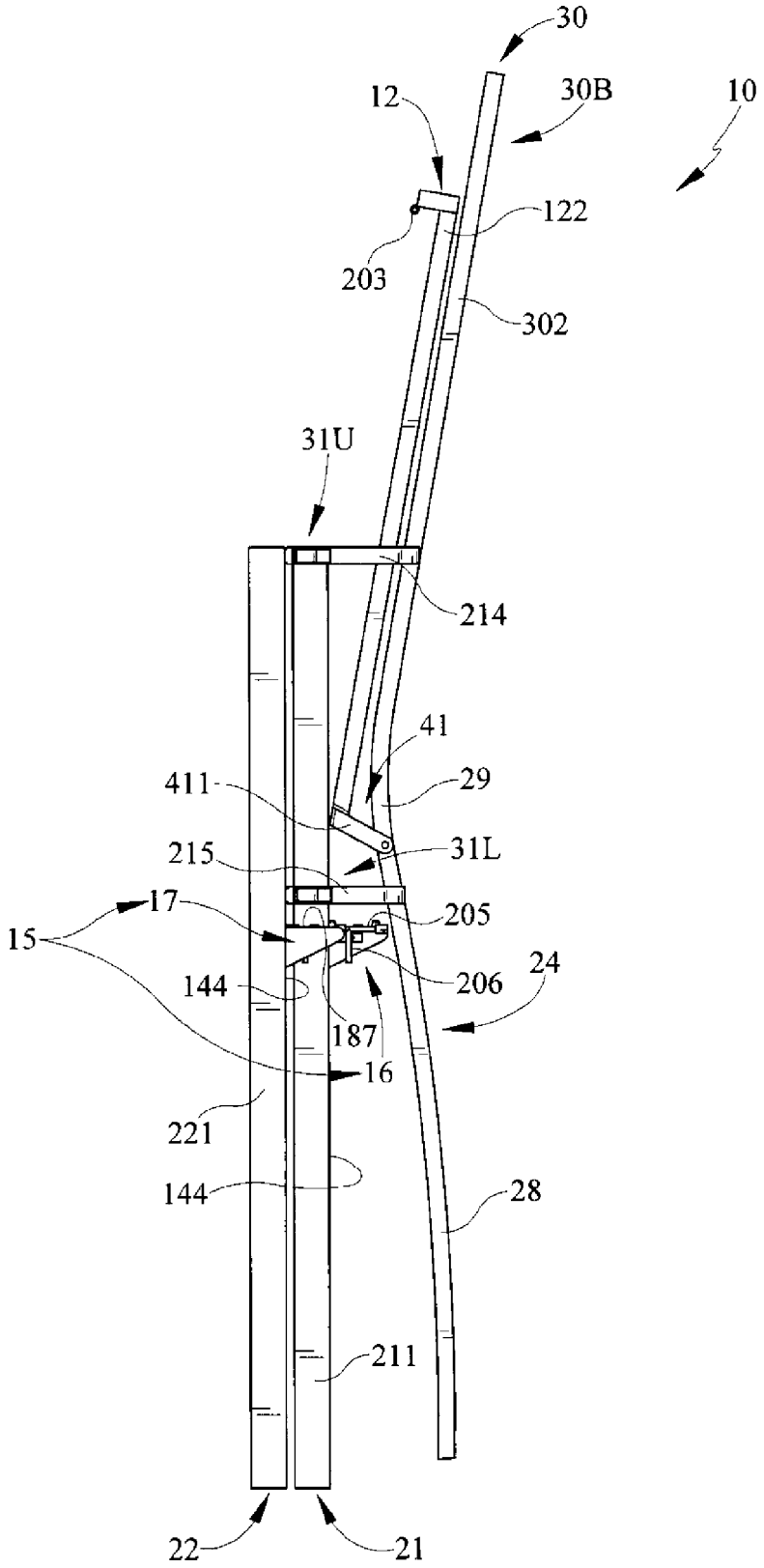
FIG. 4 is a side elevation view taken from the perspective line 4-4 of FIG. 3 showing the seat bottom trapped between the seat back and the two foldable gatefold leg units.
Figure 5:
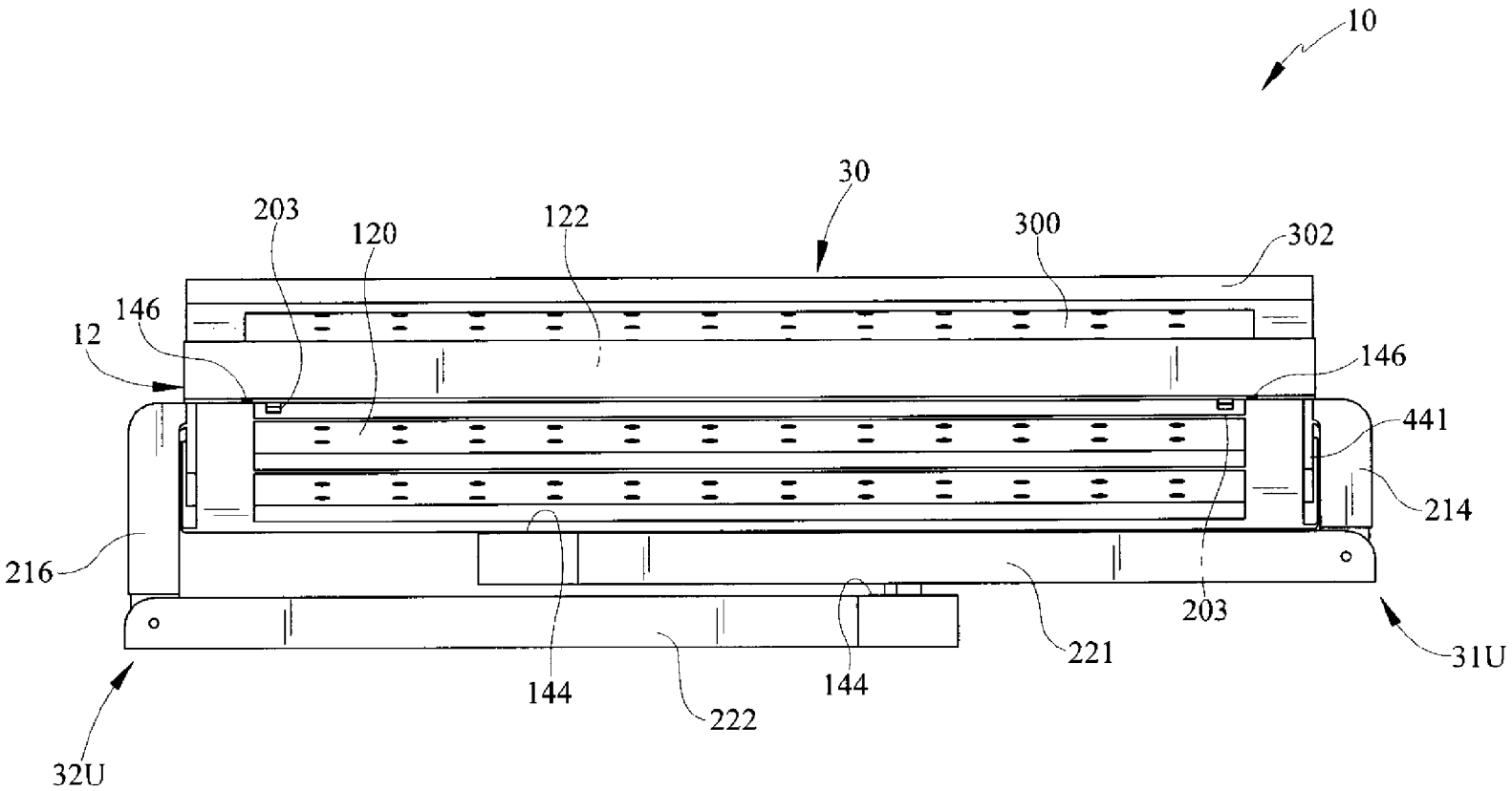
FIG. 5 is a top plan view taken from the perspective of line 5-5 of FIG. 3.

Retractable seat-bottom support 14 is coupled to frame 11 as suggested in FIGS. 1 and 5. First gatefold leg unit 21 is included in retractable seat-bottom support 14 and is mounted on frame 11 for movement between an extended position shown in FIG. 1 and a retracted position shown in FIGS. 2-5. Second gatefold leg unit 22 is also included in retractable seat-bottom support 14 and is mounted on frame 11 for movement between an extended position shown in FIGS. 1 and 2 to a retracted position shown in FIGS. 3-5.

Figure 6:
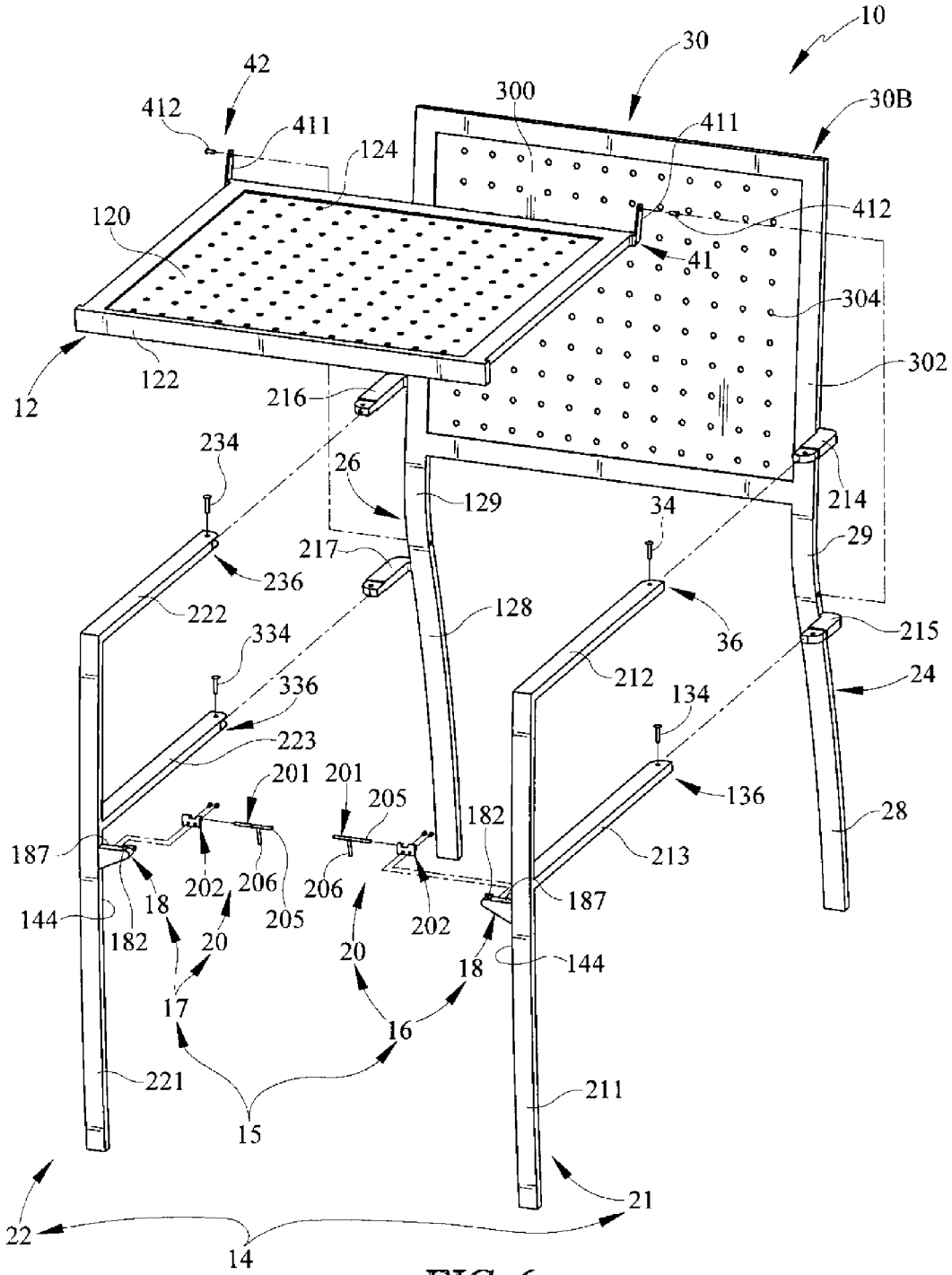
FIG. 6 is an exploded perspective assembly view of components included in the folding chair of FIGS. 1-5 showing the foldable seat bottom, the seat back, the F-shaped foldable first and second gatefold leg units, two spaced-apart seat-bottom retainers under the seat bottom, the frame, and other components that cooperate to support the seat bottom and the gatefold leg units for pivoting movement relative to the frame.

First gatefold leg unit 21 includes a front leg 211, an upper rail 212, and a lower rail 213 as shown, for example, in FIGS. 5 and 6. In an illustrative embodiment, first gatefold leg unit 21 is F-shaped as shown in FIG. 6. Front leg 211 is arranged to extend vertically and at about right angles to rails 212, 213. Upper rail 212 is coupled to an upper portion of front leg 211. Lower rail 213 is coupled to a middle portion of front leg 211 and arranged to lie in spaced-apart parallel relation to the overlying upper rail 212.

Second gatefold leg unit 22 includes a front leg 221, an upper rail 222, and a lower rail 223 as shown, for example, in FIGS. 1 and 6. In an illustrative embodiment, second gatefold leg unit 22 is F-shaped as shown in FIG. 6. Front leg 221 is arranged to extend vertically and at about right angles to rails 222, 223. Upper rail 222 is coupled to an upper portion of front leg 221. Lower rail 223 is coupled to a middle portion of front leg 221 and arranged to lie in spaced-apart parallel relation to the overlying upper rail 222.

First seat-bottom retainer 16 is coupled to first gatefold leg unit 21 to move therewith. First seat-bottom retainer 16 is configured to provide means for interconnecting seat bottom 12 and first gatefold leg unit 21 to cause movement of seat bottom 12 away from the unfolded use position to be blocked as desired by a user. Second seat-bottom retainer 17 is configured to provide means for interconnecting seat bottom 12 and second gatefold leg unit 22 to cause movement of seat bottom 12 away from the unfolded use position to be blocked when desired by a user. Second seat-bottom retainer 17 is substantially the same as first seat-bottom retainer 16, and thus, only first seat-bottom retainer 16 will be discussed in detail.

First seat-bottom retainer 16 includes a seat-bottom support brace 18 and a seat-bottom lock 20 as shown in FIG. 6. Seat-bottom support brace 18 is configured to provide means for supporting seat bottom 12 when in the unfolded use position and for aligning seat bottom 12 on seat-bottom support brace 18 so that seat-bottom lock 20 may be used to block unintended movement of seat bottom 12 away from seat-bottom support brace 18.

A user blocks movement of seat bottom 12 from the unfolded use position by moving seat bottom lock 20 from the unlocked position shown in FIGS. 7 and 8 to the locked position shown in FIG. 9. As an example, seat-bottom lock 20 includes a locking pin 201, a locking-pin carrier 202, and a locking-pin receiver 203 as illustrated in FIGS. 7-9. Locking-pin carrier 202 is coupled to seat-bottom support brace 18 in a fixed position relative to seat-bottom support brace 18. Locking pin 201 is coupled to seat-bottom support brace 18 to move back and forth along a locking-pin axis 204 between a withdrawn position shown in FIG. 7 and an inserted position shown in FIG. 9. When locking pin 201 is in the withdrawn position, locking pin 201 is spaced apart from locking-pin receiver. When locking pin 201 is in the inserted position, locking pin 201 is engaged with and received in locking-pin receiver 203.

Locking pin 201 includes an axle 205 and an axle mover 206 as shown in FIGS. 7-9. Axle 205 is aligned with locking-pin axis 204. Axle mover 206 is coupled to axle 205 about a midpoint of axle 205 and is arranged to extend away from axle 205 at about a right angle. A user in the field uses axle mover 206 to move axle 205 back and forth between the withdrawn and the inserted positions. As an example, axle mover 206 moves axle 205 in an axially inward direction 48 to move from the withdrawn position of FIG. 7 to the inserted position of FIG. 9.

Axle mover 206 is also used to pivot axle 205 about locking-pin axis 204 between a freed position as shown in FIGS. 7 and 8 and a blocked position shown in FIG. 9. When axle 205 is rotated to the freed position, axle mover 206 is arranged to extend outwardly from axle 205 at about a three o'clock position as illustrated in FIG. 7. When axle 205 is rotated in a clockwise direction 46 about locking-pin axis 204 to the blocked position, axle mover 206 is arranged to extend outwardly from axle 205 at about the six o'clock position. When locking pin 201 is in the blocked position, movement of axle 205 along locking-pin axis 204 is blocked as a result of axle mover 206 being trapped between either a first guide ring 207 and a center guide brace 208 or a second guide ring 209 and center guide brace 208 as shown in FIGS. 7-9.

Locking-pin receiver 203 is illustratively a hollow cylinder coupled to a lower surface 138 of panel perimeter 122. Locking-pin receiver 203 is formed to include a pin passageway 140 and first and second pin-receiving apertures 142 that open into pin passageway 140 so that axle 205 may move along locking-pin axis 204, pass through first pin-receiving aperture 142 and enter pin passageway 140 so that seat bottom 12 will be interconnected with retractable seat-bottom support 14.

Seat-bottom support brace 18 illustratively includes a support 181 and a locating pin 182 as shown in FIGS. 7-9. Support 181 includes a triangular first bracket 183, a triangular second bracket 184, a bracket mount 185, and a flange 186 as shown in FIGS. 7-9. Mount 185 is coupled to an inner surface 144 of front leg 211 of foldable first gatefold leg unit 21. First bracket 183 is coupled to mount 185 and arranged to extend away from gatefold leg unit 21 toward gatefold leg unit 22. Second bracket 184 is spaced apart from first bracket 183. Flange 186 is coupled to bracket mount 185 and brackets 183, 184 to establish a flat horizontal surface 187 that lies in confronting relation with lower surface 138 of panel perimeter 122 as shown in FIGS. 2 and 4.

Locating pin 182 of seat-bottom support brace 18 is coupled to flange 186 and arranged to extend upwardly toward lower surface 138 of panel perimeter 122. Lower surface 138 of panel perimeter 122 is formed to include a locating pin aperture 146 which is configured to receive locating pin 182 therein when seat bottom 12 is in the unfolded use position. Locating pin 182 and locating-pin aperture 146 cooperate to provide means for guiding seat bottom 12 into the unfolded use position and aligning locking-pin receiver 203 along locking-pin axis 204 so that locking pin 201 may be moved to the inserted position and then rotated to the blocked position so that seat bottom 12 is retained in the unfolded use position.

Before seat bottom 12 is moved from the compact folded storage position shown in FIG. 3 to the unfolded use position shown in FIG. 1, foldable first and second gatefold leg units 21, 22 are moved from the retracted positions shown in FIG. 3 to the extended positions shown in FIG. 1. Movement of foldable first and second gatefold units 21, 22 is achieved by using companion first and second hinges 31, 32 as suggested in FIG. 2.

First hinge 31 is also included in folding chair 10 and configured to support first gatefold leg unit 21 for pivoting movement in a clockwise direction about first vertical pivot axis 131 relative to frame 11 as suggested in FIGS. 1 and 2. In an illustrative embodiment, first hinge 31 is coupled to first gatefold leg unit 21 and to rear leg 28 of first upright post 24 included in frame 11. First hinge 31 provides means for supporting first gatefold leg unit 21 for movement relative to frame 11 between an extended position shown in FIGS. 1 and 6 and a retracted position shown in FIGS. 2-5.

Second hinge 32 is also included in folding chair 10 and is configured to support second gatefold leg unit 22 for pivoting movement in a counter-clockwise direction 50 about second vertical pivot axis 132 relative to frame 11 as suggested in FIG. 2 and shown in FIG. 3. In an illustrative embodiment, second hinge 32 is coupled to second gatefold leg unit 22 and to rear leg 128 of second upright post 26 included in frame 11. Second hinge 32 provides means for supporting second gatefold leg unit 22 for movement relative to frame 11 between an extended position shown in FIGS. 1 and 6 and a retracted position shown in FIGS. 2-5.

As suggested in FIG. 1, when moved to their extended positions, first and second gatefold leg units 21, 22 cooperate to provide means for supporting seat bottom 12 in a substantially horizontal extended use position. When moved to their retracted positions alongside frame 11, first and second gatefold leg units 21, 22 cooperate to retain seat bottom 12 in the compact folded storage position by trapping seat bottom 12 between seat back 30 and foldable first gatefold leg unit 21 as shown in FIGS. 2-5. When first and second gatefold leg units 21, 22 of folding seat 10 are in the extended positions, gatefold leg units 21, 22 are spaced from one another a first distance 58. When first and second gatefold leg units 21, 22 of folding seat 10 are in the retracted positions, gatefold leg units 21, 22 are arranged to overlap one another and lie in confronting relation to one another as illustrated in FIG. 3.

In an illustrative embodiment, first hinge 31 includes an upper hinge unit 31U associated with upper rail 212 of first gatefold leg unit 21 and a lower hinge unit 31L associated with lower rail 213 of first gatefold leg unit 21 as suggested in FIGS. 1 and 6. As shown best in FIG. 6, upper hinge unit 31U includes a hinge pin 34 and a pin mount 36 coupled to upper rail 212 of foldable first gatefold leg unit 21. Hinge pin 34 is sized to pass through pin-receiving apertures formed in pin mount 36 and a mount rail 214 included in foldable first gatefold leg unit 21 to establish first vertical pivot axis 131.

Similarly, lower hinge unit 31L includes a hinge pin 134 and a pin mount 136 coupled to lower rail 213.

In an illustrative embodiment, second hinge 32 includes an upper hinge unit 32U associated with upper rail 272 of second gatefold leg unit 22 and a lower hinge unit 32L associated with lower rail 23 of second gatefold leg unit 22 as suggested in FIG. 2. As shown best in FIG. 6, upper hinge unit 32U includes a hinge pin 234 and a pin mount 236 coupled to upper rail 222 of foldable first gatefold leg unit 21. Hinge pin 234 is sized to pass through pin-receiving apertures formed in pin mount 236 and a mount rail 216 included in foldable first gatefold leg unit 22 to establish second vertical pivot axis 132. Similarly, lower hinge unit 32L includes a hinge pin 334 and a pin mount 346 coupled to lower rail 223.

Figure 10:
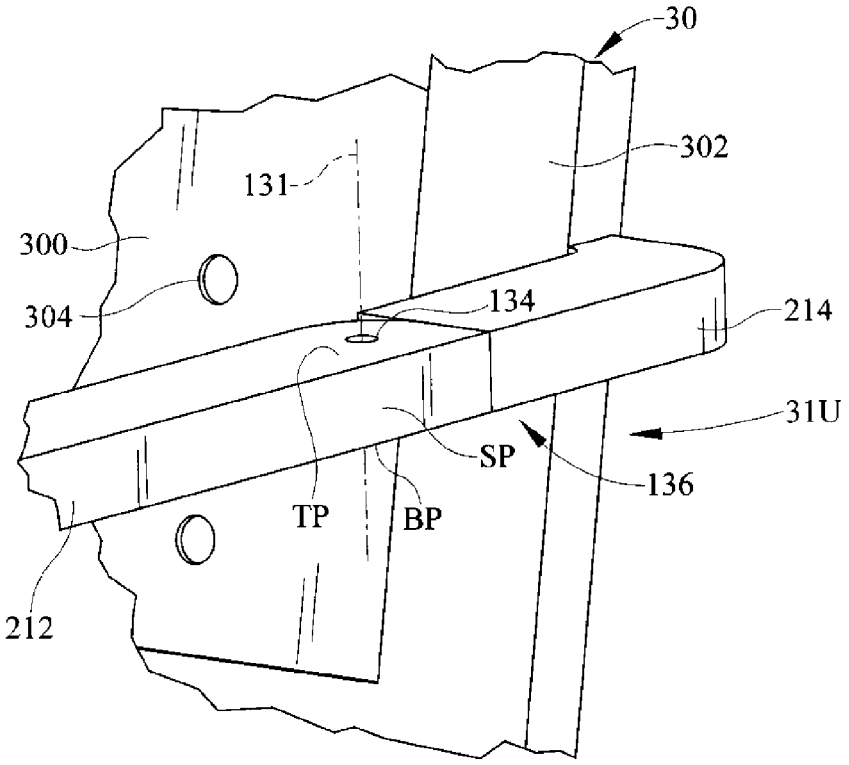
FIG. 10 is an enlarged partial perspective view showing a first upper hinge unit that interconnects the first gatefold leg unit to the frame to pivot about the first vertical pivot axis.
Figure 11:
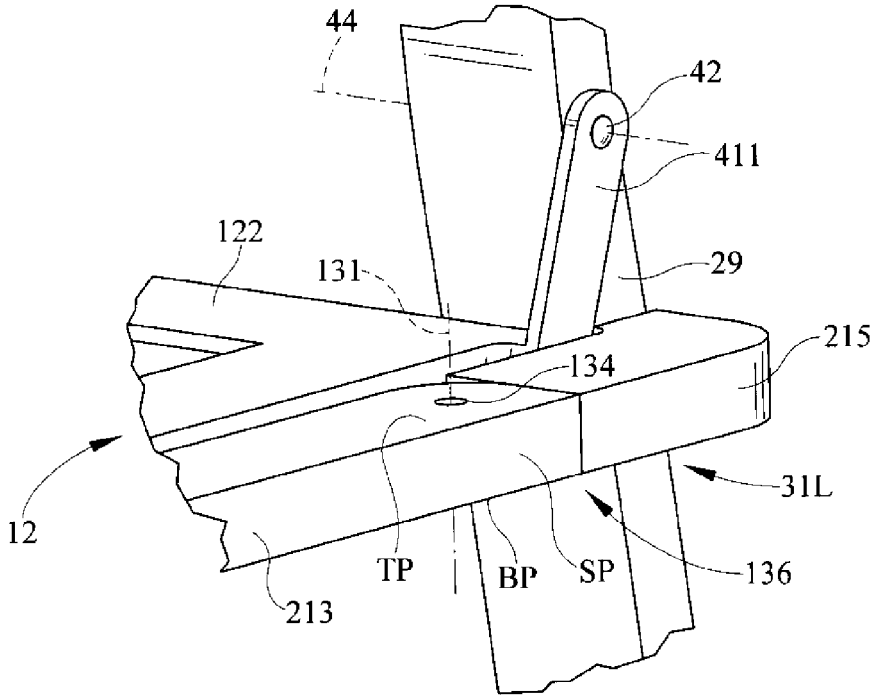
FIG. 11 is an enlarged partial perspective view showing a first lower hinge unit that cooperates with the first upper hinge unit to interconnect the first gatefold leg unit to the frame to pivot about the first vertical pivot axis and showing a first seat-panel connector unit that interconnects the seat bottom to the frame for pivotable movement about the horizontal pivot axis.

Each of pin mounts 36, 136, 236, and 336 is formed to include a rail-receiving space as suggested in FIGS. 10 and 11. Each pin mount includes a top panel (TP) formed to receive a pin-receiving aperture, a bottom panel (BP) formed to receive a pin-receiving aperture, and a side panel (SP) arranged to interconnect the companion top and bottom panels (TP, BP) and to retain the companion top and bottom panels (TP, BP) in spaced-apart parallel relation to one another to form a rail-receiving space therebetween.

Each pin mount 36, 136, 236, and 336 is arranged to form a rail-pivot shield and to receive a free end of its companion mount rail 214, 215, 216, and 217 therein during movement of first and second gatefold leg units 21, 22 relative to frame 11 as suggested in FIGS. 1-4. Mount rails 214, 215 are included in first gatefold leg unit 21 and mount rails 216, 217 are included in second gatefold leg unit 22. The rail-pivot shield feature provided by pin mounts 36, 136, 236, and 336 provides means for shielding the companion hinge pins from exposure to any person that is handling folding chair 10 while seat bottom 12 and gatefold leg units 21, 22 are folded and unfolded.

Seat back 30 includes a back pad 300 and a pad perimeter 302 as suggested in FIGS. 1 and 6. In an illustrative embodiment, pad perimeter 302 is made of metal and back pad 300 is made of metal and formed to include a plurality of spaced-apart drain holes 304. However, pad perimeter 302 may be made of metal and back pad 300 may comprise a series of wooden slats extending horizontally across pad perimeter 302. In another example, pad perimeter 302 may be made of metal and back pad 300 may comprise a series of metal slats, however, seat back 30 may be made of any other suitable material. In the illustrated embodiment, pad perimeter 302 of seat back 30 is welded to back-support arm 29 of first upright post 24 of frame 11 and to back-support arm 129 of second upright post 26 of frame 11.

Seat bottom 12 includes a panel 120 and panel perimeter 122 as suggested in FIG. 6. In an illustrative embodiment, panel perimeter 122 is made primarily of metal and panel 120 is made of metal formed to include a series of drain holes 124 spaced apart from one another. In another embodiment, panel perimeter 122 and panel 120 may be made of wood and panel 120 may comprise a series of slats extending horizontally across panel perimeter 122, however, seat bottom 12 may be made of any other suitable material.

A seat-bottom mover 40 is included in folding chair 10 and coupled to seat bottom 12 and frame 11 as suggested in FIGS. 2, 3, 6, and 11. Seat-bottom mover 40 is configured to provide means for guiding seat bottom 12 from the extended use position shown in FIGS. 1 and 6 to a raised position shown in FIGS. 2-5 (to facilitate folding of first and second gatefold leg units 21, 22 to retracted positions alongside seat bottom 12) so that the compact folded storage position shown in FIGS. 3-5 is achieved.

Seat-bottom mover 40 includes first and second panel connectors 41, 42 as shown in FIG. 6. First panel connector 41 includes a link rail 411 and a rail pivot pin 412. A first end of link rail 411 is coupled to panel perimeter 122 to move therewith. Link rail 411 is arranged to extend upwardly away from panel perimeter 122 toward backrest perimeter 302. Link rail 411 is coupled to backrest perimeter 302 by rail pivot pin 412 which extends through an aperture formed in link rail 411 so that link rail 411 and seat bottom 12 may pivot about horizontal seat-bottom pivot axis 44 as shown in FIG. 11. Second panel connector 42 is substantially the same as first panel connector 41, and thus, only first panel connector 41 is discussed in detail.

As suggested in, for example, FIGS. 2-5, seat bottom 12 can be moved about horizontal seat-bottom pivot axis 44 relative to frame 11 to assume a retracted position. In this position, foldable first and second gatefold leg units 21, 22 may moved from the extended position of FIGS. 1 and 6 to the retracted position of FIGS. 2-5. After foldable first and second gatefold leg units 21, 22 are in the retracted position, foldable first gatefold leg unit 21 and seat back 30 cooperate to provide therebetween chamber means for storing portions of seat bottom 12 therein as suggested in FIGS. 2-5.

In an illustrative embodiment, each of first and second gatefold leg units 21, 22 is mated to frame 11 using two hinge units 31U, 31L or 32U, 32L. This functions to strengthen each gatefold leg unit 21, 22 with a rigid cross brace and minimizes rocking motion without otherwise detracting from appearance or function. Also, leg units 21, 22 fold like a gate on hinges 31, 32 attached to rear legs 28, 128. Seat bottom 12 pivots up out of the way before gatefold leg units 21, 22 are folded from the extended positions to the retracted positions.

A folding bench 510 in accordance with the present disclosure can be folded as suggested in FIGS. 12-16. Folding bench 510 is a long seat for more than one person. Folding bench 510 includes frame 11 and a foldable seat bottom 512 mounted for movement relative to frame 11 between an unfolded use position shown in FIG. 12 and a compact folded storage position shown in FIGS. 14-16. Foldable seat bottom 512 is supported by retractable seat-bottom support 14 comprising foldable first and second gatefold leg units 21, 22 when folding bench 510 is erected as suggested in FIGS. 12 and 17. Seat bottom 512 is coupled to first and second gatefold leg units 21, 22 by first and second seat-bottom retainers 16, 17 so that seat bottom 512 is retained in the unfolded use position.

Figure 12:
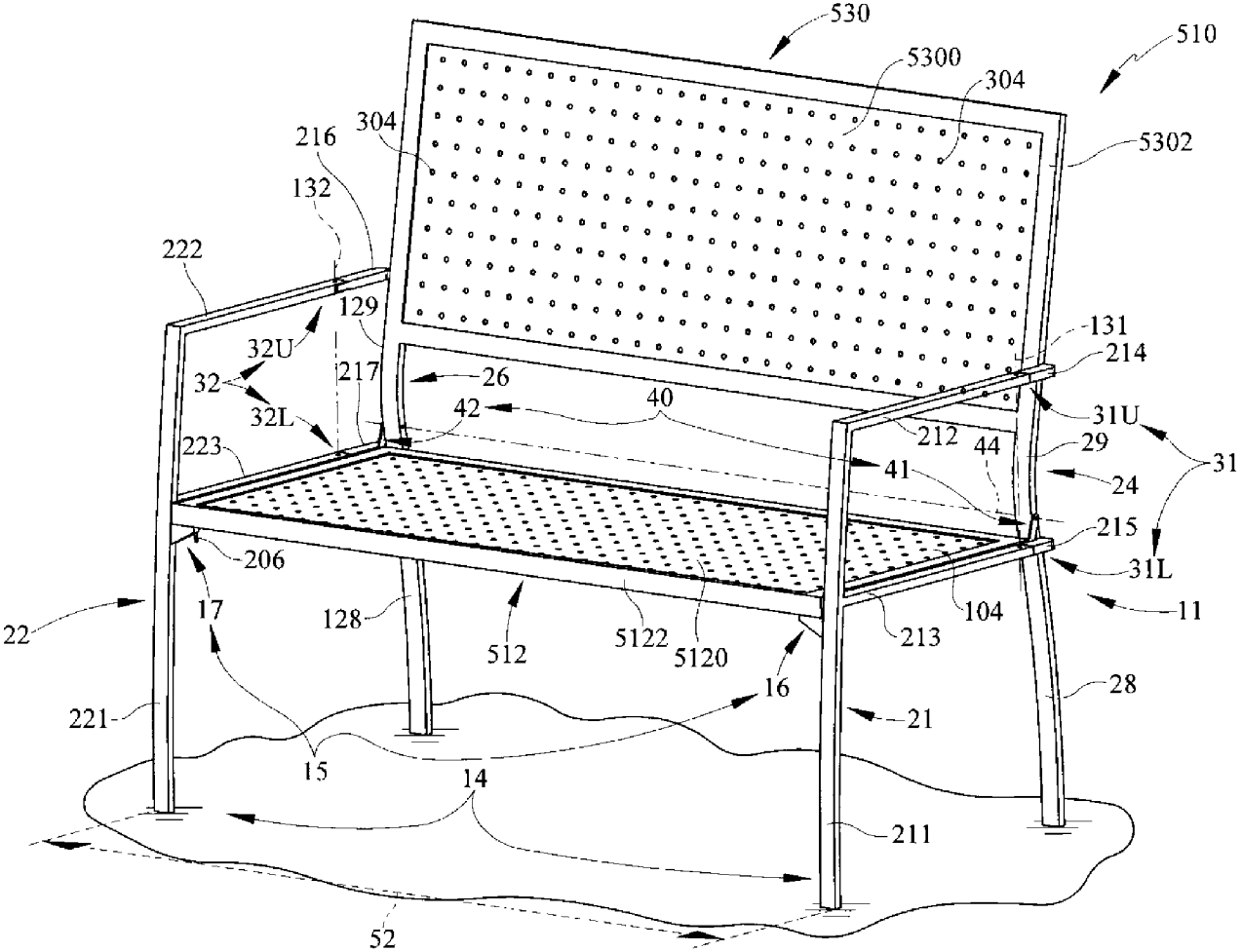
FIG. 12 is a perspective view of a folding bench in accordance with the present disclosure.

Frame 11 includes first and second upright posts 24, 26 as shown in FIG. 12. In an illustrative embodiment, first upright post 24 includes rear leg 28 and back-support arm 29 coupled to rear leg 28 and to a seat back 530 included in folding bench 510. Second upright post 26 includes rear leg 128 and back-support arm 129 coupled to rear leg 128 and to seat back 530. Seat back 530 is arranged to interconnect and extend between back-support arms 29 and 129 as shown in FIG. 17.

Retractable seat-bottom support 14 is coupled to frame 11 as suggested in FIGS. 1 and 5. First gatefold leg unit 21 is included in retractable seat-bottom support 14 and is mounted on frame 11 for movement between an extended position shown in FIG. 12 and a retracted position shown in FIGS. 13-16. Second gatefold leg unit 22 is also included in retractable seat-bottom support 14 and mounted on frame 11 for movement between an extended position shown in FIGS. 12 and 13 and a retracted position shown in FIGS. 14-16.

Figure 16:
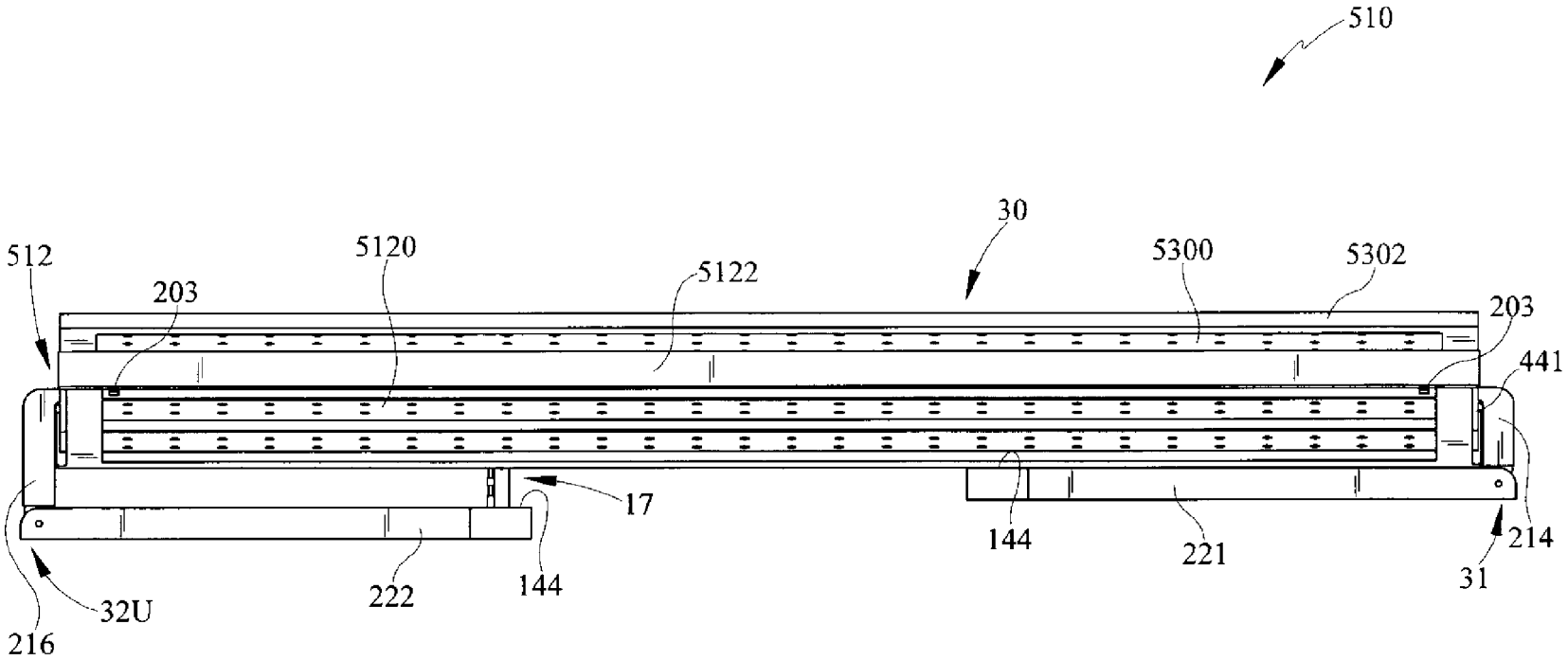
FIG. 16 is a top plan view taken from the perspective of line 5-5 of FIG. 3.
Figure 17:
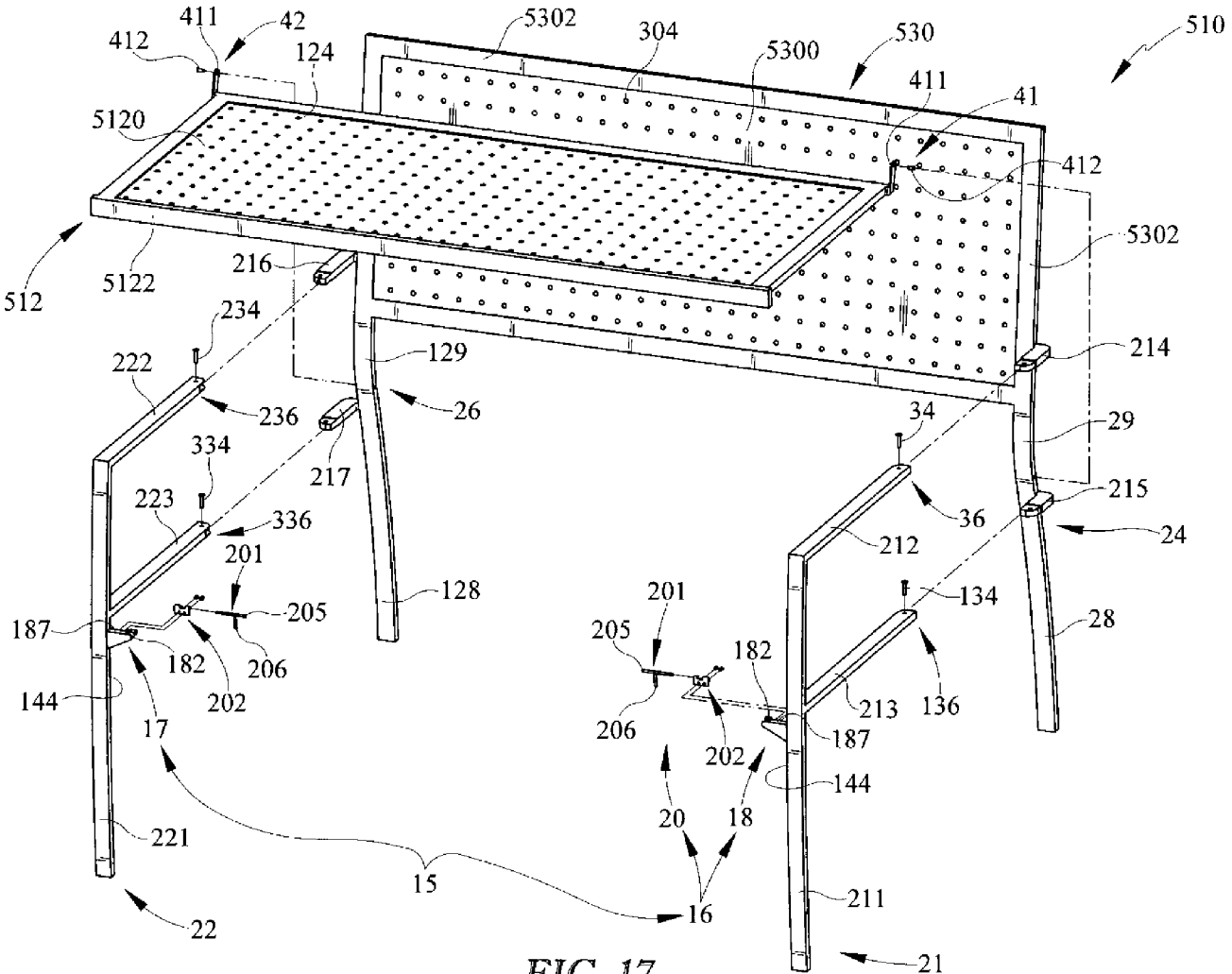
FIG. 17 is an exploded perspective assembly view of components included in the folding bench of FIGS. 12-16 showing the foldable seat bottom, the seat back, the F-shaped foldable first and second gatefold leg units, two spaced-apart seat-bottom retainers under the seat bottom, the frame, and other components that cooperate to support the seat bottom and the gatefold leg units for pivoting movement relative to the frame.

First gatefold leg unit 21 includes front leg 211, upper rail 212, and lower rail 213 as shown, for example, in FIGS. 16 and 17. In an illustrative embodiment, first gatefold leg unit 21 is F-shaped as shown in FIGS. 12 and 17. Front leg 211 is arranged to extend vertically and at about right angles to rails 212, 213. Upper rail 212 is coupled to an upper portion of front leg 211. Lower rail 213 is coupled to a middle portion of front leg 211 and arranged to lie in spaced-apart parallel relation to the overlying upper rail 212.

Second gatefold leg unit 22 includes front leg 221, upper rail 222, and lower rail 223 as shown, for example, in FIGS. 12 and 17. In an illustrative embodiment, second gatefold leg unit 22 is F-shaped as shown in FIG. 17. Front leg 221 is arranged to extend vertically and at about right angles to rails 222, 223. Upper rail 222 is coupled to an upper portion of front leg 221. Lower rail 223 is coupled to a middle portion of front leg 221 and arranged to lie in spaced-apart parallel relation to the overlying upper rail 222.

First seat-bottom retainer 16 is coupled to first gatefold leg unit 21 to move therewith. First seat-bottom retainer 16 is configured to provide means for interconnecting seat bottom 512 and first gatefold leg unit 21 to cause movement of seat bottom 512 from the unfolded use position to be blocked when desired by a user. Second seat-bottom retainer 17 is configured to provide means for interconnecting seat bottom 512 and second gatefold leg unit 22 to cause movement of seat bottom 512 from the unfolded use position to be blocked when desired by a user. Second seat-bottom retainer 17 is substantially the same as first seat-bottom retainer 16, and thus, only first seat-bottom retainer 16 will be discussed in detail.

As shown in FIG. 17, first seat bottom retainer 16 includes seat-bottom support brace 18 and seat-bottom lock 20. Seat-bottom support brace 18 is configured to provide means for supporting seat bottom 512 when in the unfolded use position and for aligning seat bottom 512 on seat-bottom support brace 18 so that seat-bottom lock 20 may be used.

A user blocks movement of seat bottom 512 by moving seat bottom lock 20 from the unlocked position of FIGS. 7 and 8 to the locked position of FIG. 9. As an example, seat-bottom lock 20 includes locking pin 201, locking-pin carrier 202, and locking-pin receiver 203 as illustrated in FIGS. 7-9. Locking-pin carrier 202 is coupled to seat-bottom support brace 18 in the fixed position relative to seat-bottom support brace 18. Locking pin 201 is coupled to seat-bottom support brace 18 to move back and forth along locking-pin axis 204 between the withdrawn position shown in FIG. 7 and the inserted position shown in FIG. 9. When locking pin 201 is in the withdrawn position, locking pin 201 is spaced apart from locking-pin receiver 203. When locking pin 201 is in the inserted position, locking pin 201 is engaged with and received in locking-pin receiver 203.

Locking pin 201 includes axle 205 and axle mover 206 as shown in FIGS. 7-9. Axle 205 is aligned with locking-pin axis 204. Axle mover 206 is coupled to axle 205 about the mid-point of axle 205 and is arranged to extend away from axle 205 at about the right angle. A user in the field uses axle mover 206 to move axle 205 back and forth between the withdrawn and the inserted positions. As an example, axle mover 206 moves axle 205 in an axially inward direction 48 to move from the withdrawn position of FIG. 7 to the mated position of FIG. 9.

Axle mover 206 is also used to pivot axle 205 about locking-pin axis 204 between a freed position as shown in FIGS. 7 and 8 and a blocked position shown in FIG. 9. When axle 205 is rotated to the freed position, axle mover 206 is arranged to extend outwardly from axle 205 at about a three o'clock position as illustrated in FIG. 7. When axle 205 is rotated in a clockwise direction 46 about locking-pin axis 204 to the blocked position, axle mover 206 is arranged to extend outwardly from axle 205 at about the six o'clock position. When locking pin 201 is in the blocked position, movement of axle 205 along locking-pin axis 204 is blocked as a result of axle move 206 being trapped between either first guide ring 207 and center guide brace 208 or second guide ring 209 and center guide brace 208 as shown in FIGS. 7-9.

Locking-pin receiver 203 is illustratively hollow cylinder coupled to lower surface 138 of panel perimeter 5122. Locking-pin receiver 203 is formed to include pin passageway 140 and first and second pin-receiving apertures 142 that open into pin passageway 140 so that axle 205 may move along locking-pin axis 204, pass through first pin-receiving aperture 142 and enter pin passageway 140 so that seat bottom 512 will be interconnected with retractable seat-bottom support 14.

Figure 13:
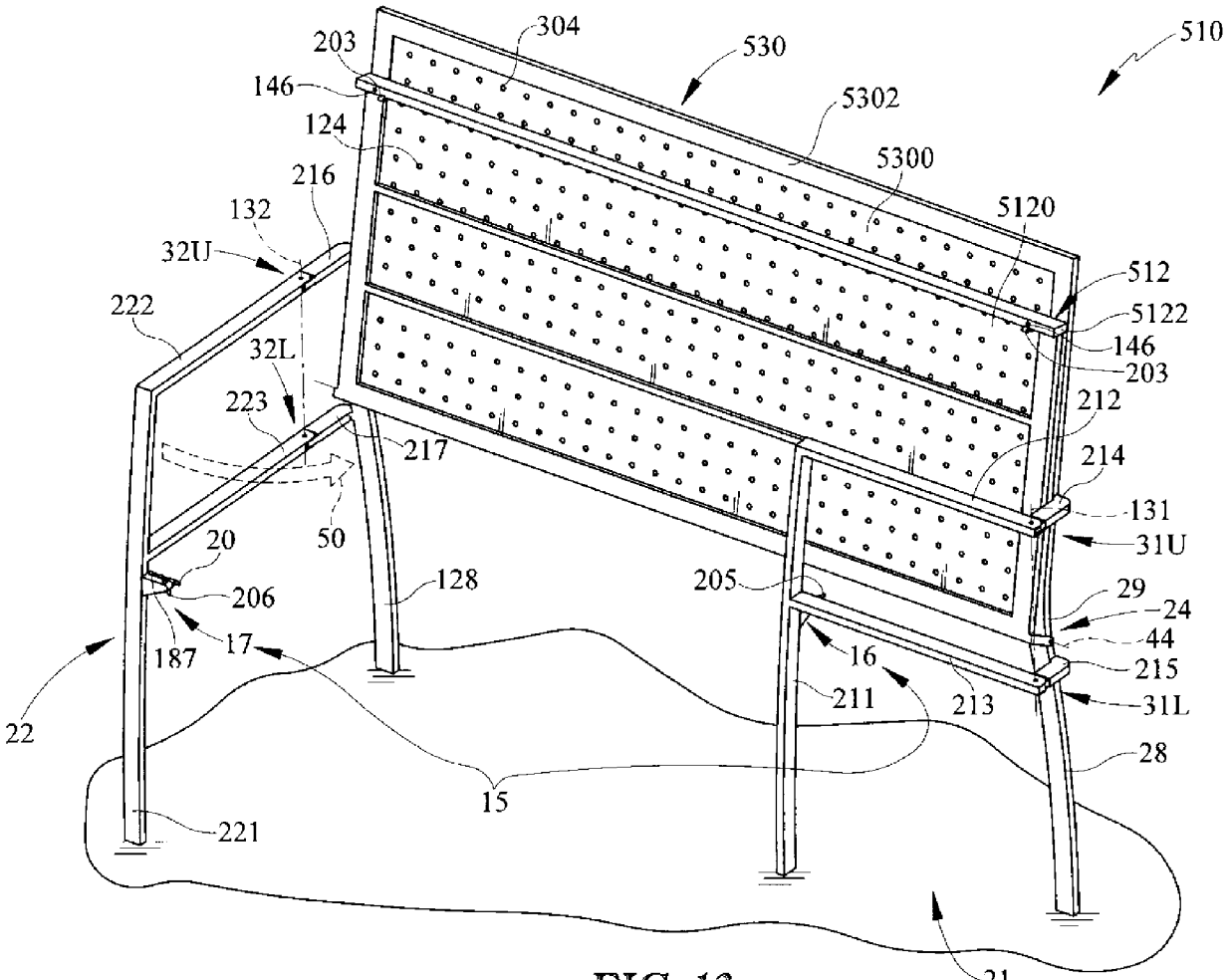
Figure 15:
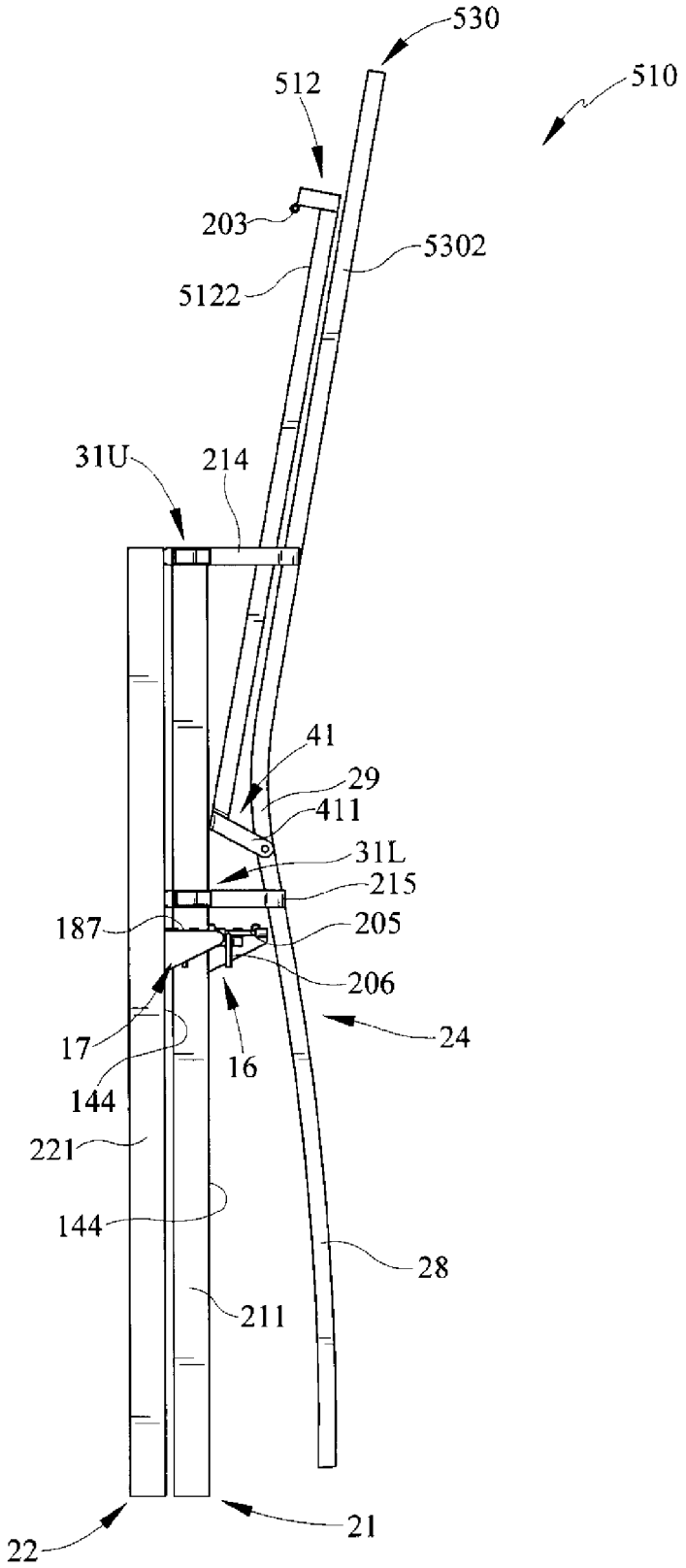
FIG. 15 is a side elevation view taken from the perspective line 15-15 of FIG. 14 showing the seat bottom trapped between the seat back and the two foldable gatefold leg units.

Seat-bottom support brace 18 illustratively includes support 181 and locating pin 182 as shown in FIGS. 7-9. Support 181 includes triangular first bracket 183, triangular second bracket 184, bracket mount 185, and flange 186 as shown in FIGS. 7-9. Mount 185 is coupled to inner surface 144 of front leg 211 of foldable first gatefold leg unit 21. First bracket 183 is coupled to mount 185 and is arranged to extend away from gatefold leg unit 21 toward gatefold leg unit 22. Second bracket 184 is spaced apart from first bracket 183. Flange 186 is coupled to bracket mount 185 and brackets 183, 184 to establish a flat horizontal surface 187 that lies in confronting relation with lower surface 5138 of panel perimeter 5122 as shown in FIGS. 13 and 15.

Locating pin 182 is coupled to flange 186 and arranged to extend upwardly toward lower surface 5138 of panel perimeter 5122. Lower surface 5138 is formed to include locating-pin aperture 146 which is configured to receive locating pin 182 therein when seat bottom 512 is in the unfolded use position. Locating pin 182 and locating-pin aperture 146 cooperate to provide means for guiding seat bottom 512 into the unfolded use position and aligning locking-pin receiver 203 along locking-pin axis 204 so that locking pin 201 may be move to the mated position and blocked positions so that the seat bottom is retained in the unfolded use position.

Figure 14:
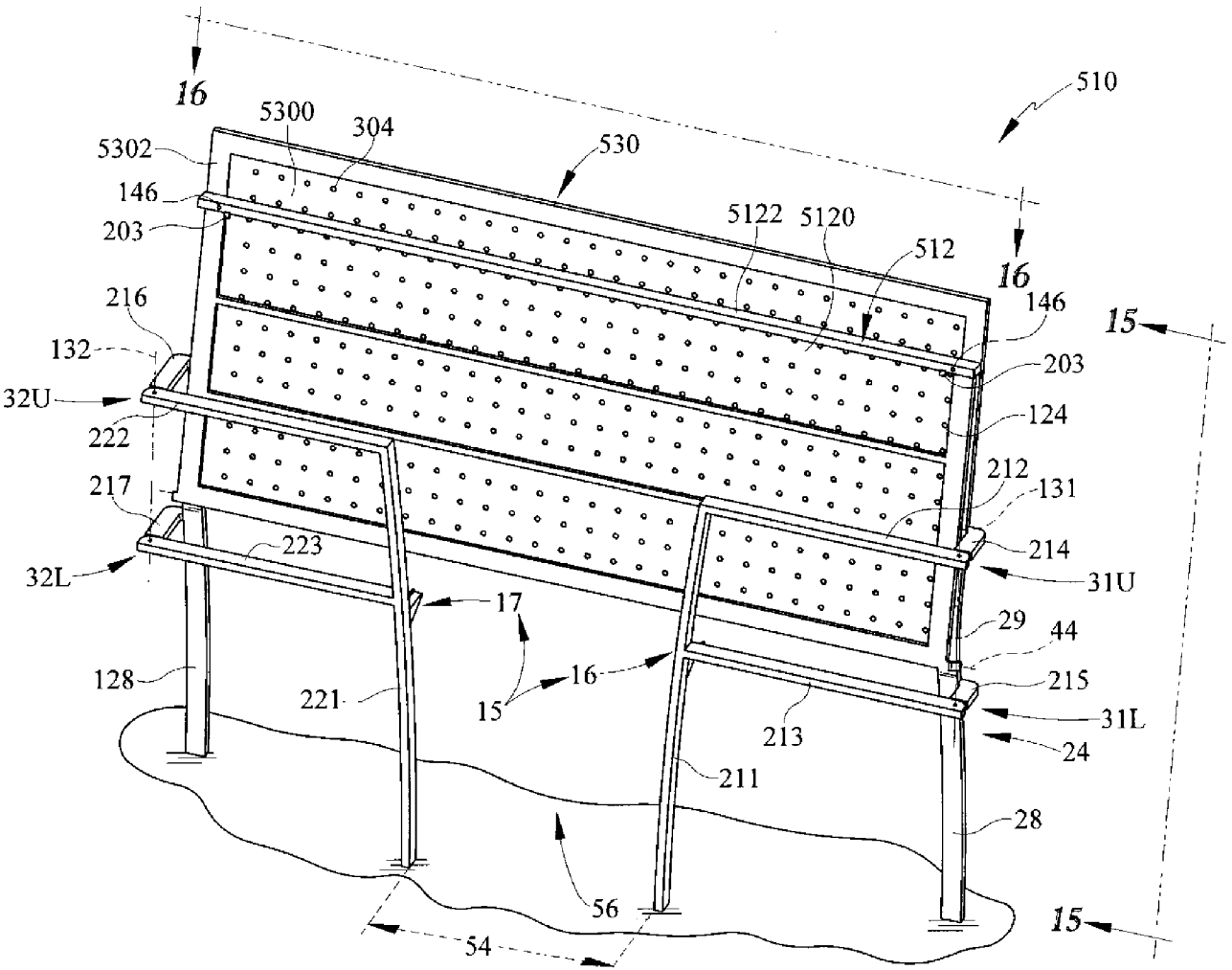

Before seat bottom 512 is moved from the compact folded storage position shown in FIG. 14 to the unfolded use position shown in FIG. 12, foldable first and second gatefold leg units 21, 22 are moved from the retracted positions shown in FIG. 14 to the extended position shown in FIG. 1. Movement of foldable first and second gatefold units 21, 22 is achieved by using companion first and second hinges 31, 32 as suggested in FIG. 2.

First hinge 31 is also included in folding bench 510 and is configured to support first gatefold leg unit 21 for pivoting movement in a clockwise direction about first vertical pivot axis 131 relative to frame 11 as suggested in FIGS. 1 and 2. In an illustrative embodiment, first hinge 31 is coupled to first gatefold leg unit 21 and to rear leg 28 of first upright post 24 included in frame 11. First hinge 31 provides means for supporting first gatefold leg unit 21 for movement relative to frame 11 between the extended position shown in FIGS. 12 and 17 and the retracted position shown in FIGS. 13-16.

Second hinge 32 is also included in folding bench 510 and is configured to support second gatefold leg unit 22 for pivoting movement in a counter-clockwise direction 50 about second vertical pivot axis 132 relative to frame 11 as suggested in FIG. 13 and shown in FIG. 14. In an illustrative embodiment, second hinge 32 is coupled to second gatefold leg unit 22 and to rear leg 128 of second upright post 26 included in frame 11. Second hinge 32 provides means for supporting second gatefold leg unit 22 for movement relative to frame 11 between the extended position shown in FIGS. 1 and 6 and the retracted position shown in FIGS. 2-5.

As suggested in FIG. 1, when moved to their extended positions, first and second gatefold leg units 21, 22 cooperate to provide means for supporting seat bottom 512 in a substantially horizontal extended use position. When moved to their retracted positions alongside frame 11, first and second gatefold leg units 21, 22 cooperate to retain seat bottom 12 in the compact folded storage position. As shown in FIG. 14, seat bottom 512 is positioned to lie between seat back 530 and first and second gatefold leg units 21, 22. When first and second gatefold leg units 21, 22 of folding bench 510 are in the extended positions, gatefold leg units 21, 22 are spaced from one another a first distance 52. When first and second gatefold leg units 21, 22 of folding bench 510 are in the retracted positions, gatefold leg units 21, 22 are spaced apart from one another a relatively larger second distance 54 so as to define a space 56 therebetween as shown in FIG. 14.

In an illustrative embodiment, first hinge 31 includes upper hinge unit 31U associated with upper rail 212 of first gatefold leg unit 21 and lower hinge unit 31L associated with lower rail 213 of first gatefold leg unit 21 as suggested in FIGS. 12 and 17. As shown best in FIG. 17, upper hinge unit 31U includes hinge pin 34 and pin mount 36 coupled to upper rail 212 of foldable first gatefold leg unit 21. Hinge pin 34 is sized to pass through pin-receiving apertures formed in pin mount 36 and mount rail 214 included in foldable first gatefold leg unit 21 to establish first vertical pivot axis 131. Similarly, lower hinge unit 31L includes hinge pin 134 and pin mount 136 coupled to lower rail 213.

In an illustrative embodiment, second hinge 32 includes upper hinge unit 32U associated with upper rail 272 of second gatefold leg unit 22 and lower hinge unit 32L associated with lower rail 23 of second gatefold leg unit 22 as suggested in FIG. 13. As shown best in FIG. 17, upper hinge unit 32U includes hinge pin 234 and pin mount 236 coupled to upper rail 222 of foldable first gatefold leg unit 21. Hinge pin 234 is sized to pass through pin-receiving apertures formed in pin mount 236 and mount rail 216 included in foldable first gatefold leg unit 22 to establish second vertical pivot axis 132. Similarly, lower hinge unit 32L includes hinge pin 334 and pin mount 346 coupled to lower rail 223.

Each of pin mounts 36, 136, 236, and 336 is formed to include a rail-receiving space as suggested in FIGS. 10 and 11. Each pin mount includes top panel (TP) formed to receive a pin-receiving aperture, bottom panel (BP) formed to receive a pin-receiving aperture, and side panel (SP) arranged to interconnect the companion top and bottom panels (TP, BP) and to retain the companion top and bottom panels (TP, BP) in spaced-apart parallel relation to one another to form the rail-receiving space therebetween.

Each pin mount 36, 136, 236, and 336 is arranged to form the rail-pivot shield and to receive the free end of its companion mount rail 214, 215, 224, and 225 therein during movement of first and second gatefold leg units 21, 22 relative to frame 11 as suggested in FIGS. 12-15. The rail-pivot shield feature provided by pin mounts 36, 136, 236, and 336 provides means for shielding the companion hinge pins from exposure to any person that is handling folding bench 510 while seat bottom 512 and gatefold leg units 21, 22 are folded and unfolded.

Seat back 530 includes back pad 5300 and pad perimeter 5302 as suggested in FIGS. 12 and 17. In an illustrative embodiment, pad perimeter 5302 is made of metal and back pad 5300 is made of metal and formed to include a plurality of spaced-apart drain holes 304. However, pad perimeter 5302 may be made of metal and back pad 5300 may comprise a series of wooden slats extending horizontally across pad perimeter 5302. In another example, pad perimeter 5302 may be made of metal and back pad 5300 may comprise a series of metal slats, however, seat back 530 may be made of any other suitable material. In the illustrated embodiment, pad perimeter 5302 of seat back 530 is welded to back-support arm 29 of first upright post 24 of frame 11 and to back-support arm 129 of second upright post 26 of frame 11.

Seat bottom 512 includes a panel 5120 and panel perimeter 5122 as suggested in FIG. 17. In an illustrative embodiment, panel perimeter 5122 is made of metal and panel 5120 is made of metal formed to include a series of drain holes 124 spaced apart from one another. In another embodiment, panel perimeter 5122 and panel 5120 may be made of wood and panel 5120 may comprise a series of slats extending horizontally across panel perimeter 5122.

Seat-bottom mover 40 is included in folding bench 510 and is coupled to seat bottom 512 and frame 11 as suggested in FIGS. 12 and 17. Seat-bottom mover 40 is configured to provide means for guiding seat bottom 512 from the extended use position shown in FIGS. 12 and 17 to the raised position shown in FIGS. 13-16 (to facilitate folding of first and second gatefold leg units 21, 22 to retracted positions alongside seat bottom 512) so that the compact folded storage position shown in FIGS. 14-16 is achieved.

Seat-bottom mover 40 includes first and second panel connectors 41, 42 as shown in FIG. 17. First panel connector 41 includes link rail 411 and rail pivot pin 412. First end of link rail 411 is coupled to panel perimeter 5122 to move therewith. Link rail 411 is arranged to extend upwardly away from panel perimeter 5122 toward backrest perimeter 5302. Link rail 411 is coupled to backrest perimeter 5302 by rail pivot pin 412 which extends through the aperture formed in link rail 411 so that link rail 411 and seat bottom 12 may pivot about horizontal seat-bottom pivot axis 44 as shown in FIG. 11.

As suggested in, for example, FIGS. 13-16, seat bottom 512 can be moved about horizontal seat-bottom pivot axis 44 relative to frame 11 to assume a retracted position. In this position, foldable first and second gatefold leg units 21, 22 may be moved from the extended position of FIGS. 12 and 17 to the retracted position of FIGS. 13-16. After foldable first and second gatefold leg units 21, 22 are in the retracted position, foldable first and second gatefold leg units 21, 22 and seat back 530 cooperate to provide therebetween chamber means for storing portions of seat bottom 512 therein as suggested in FIGS. 13-16.

In an illustrative embodiment, each of first and second gatefold leg units 21, 22 is mated to frame 11 using two hinge units 31U, 31L or 32U, 32L. This functions to strengthen each gatefold leg unit 21, 22 with a rigid cross brace and minimizes rocking motion without otherwise detracting from appearance or function. Also, leg units 21, 22 fold like a gate on hinges 31, 32 attached to rear legs 28, 128. Seat bottom 512 pivots up out of the way before gatefold leg units 21, 22 are folded from the extended positions to the retracted positions.

The invention claimed is:

1. A folding chair comprising a frame includes a backrest and first and second rear legs coupled to the backrest and arranged to elevate the backrest above ground under the backrest, a foldable seat bottom mounted on the frame for pivotable movement relative to the frame about a horizontal pivot axis between a compact folded storage position alongside the backrest and an unfolded use position arranged to extend along a generally horizontal plane away from the frame wherein the backrest is arranged to extend upwardly away from a rear edge of the foldable seat bottom, and a retractable seat-bottom support configured to provide means for supporting the foldable seat bottom in the unfolded use position, the retractable seat-bottom support includes a first gatefold leg unit mounted on the frame for pivotable movement about a first vertical axis between a retracted position alongside the frame and an extended position arranged to lie under and support a first side of the foldable seat bottom upon movement of the foldable seat bottom to the unfolded use position, a second gatefold leg unit mounted on the frame for pivotable movement about a second vertical axis between a retracted position alongside the frame and an extended position arranged to lie under and support an opposite second side of the foldable eat bottom upon movement of the foldable seat bottom to the unfolded use position, and anchor means for selectively coupling the foldable seat bottom in a stationary position on the seat-bottom support after pivotable movement of the first and second gatefold leg units to the extended positions and pivotable movement of the foldable seat bottom to the unfolded use position, wherein the anchor means comprises a first seat-bottom retainer including a first seat-bottom support brace coupled to the first gatefold leg unit to move therewith and arranged to engage and support the foldable seat bottom in the unfolded use position and a first seat-bottom lock including a locking-pin receiver coupled to the foldable seat bottom for movement therewith, a locking-pin carrier coupled to the first gatefold leg unit for movement therewith and formed to include a carrier passageway that is aligned to communicate with a receiver passageway formed in the locking-pin receiver upon movement of the first gatefold leg unit to the extended position and movement of the foldable seat bottom to the unfolded use position, and a locking pin mounted for sliding movement in the carrier passageway between a withdrawn position located outside of the receiver passageway formed in the locking-pin receiver to establish an unlocked condition of the first seat-bottom retainer to free the foldable seat bottom for movement relative to the first gatefold leg unit and an inserted position arranged to extend into the receiver passageway formed in the locking-pin receiver to establish a locked condition of the first seat-bottom retainer to block movement of the foldable seat bottom relative to the first gatefold leg unit and toward the compact folded storage position alongside the backrest, wherein the locking-pin carrier includes a first guide ring coupled to the first seat-bottom support brace and a second guide ring coupled to the first seat-bottom support brace to lie in spaced-apart relation to the first guide ring to define an axle-mover space therebetween, the locking pin includes an axle mounted for back-and-forth sliding movement in the carrier passageway formed in the first and second guide rings to extend into the receiver passageway upon movement of the locking pin to the inserted position and to lie outside of the receiver passageway upon movement of the locking pin to the withdrawn position, and the locking pin further includes an axle mover coupled to the axle and arranged to extend away therefrom and the axle mover is arranged to move back and forth in the axle-mover space defined between the first and second guide rings during movement of the locking pin between the inserted end withdrawn positions.

2. The folding chair of claim 1, wherein the locking-pin carrier further includes a center guide brace arranged to lie in the axle-mover face and coupled to the first seat-bottom support brace to lie in a stationary position in the axle-mover space between the first and second guide rings, the center guide brace is formed to include a mover-receiver slot, the axle mover is arranged to lie in the mover-receiver slot and extend outwardly away from the first seat-bottom support brace at about a three o'clock position upon movement of the locking pin to the withdrawn position owing to support provided by a portion of the center guide brace arranged to lie under the axle mover, and the axle mover is arranged to lie in a space provided between the first guide ring and the center guide brace and extend downwardly away from the foldable seat bottom at about a six o'clock position upon movement of the locking pin to the inserted position.

3. A folding chair comprising a frame includes a backrest and first and second rear legs coupled to the backrest and arranged to elevate the backrest above ground under the backrest, a foldable seat bottom mounted on the frame for pivotable movement relative to the frame about a horizontal pivot axis between a compact folded storage position alongside the backrest and an unfolded use position arranged to extend along a generally horizontal plane away from the frame wherein the backrest is arranged to extend upwardly away from a rear edge of the foldable seat bottom, and a retractable seat-bottom support configured to provide means for supporting the foldable seat bottom in the unfolded use position, the retractable seat-bottom support includes a first gatefold leg unit mounted on the frame for pivotable movement about a first vertical axis between a retracted position alongside the frame and an extended position arranged to lie under and support a first side of the foldable seat bottom upon movement of the foldable seat bottom to the unfolded use position, a second gatefold leg unit mounted on the frame for pivotable movement about a second vertical axis between a retracted position alongside the frame and an extended position arranged to lie under and support an opposite second side of the foldable eat bottom upon movement of the foldable seat bottom to the unfolded use position, and anchor means for selectively coupling the foldable seat bottom in a stationary position on the seat-bottom support after pivotable movement of the first and second gatefold leg units to the extended positions and pivotable movement of the foldable seat bottom to the unfolded use position, wherein the anchor means comprises a first seat-bottom retainer including a first seat-bottom support brace coupled to the first gatefold leg unit to move therewith and arranged to engage and support the foldable seat bottom in the unfolded use position and a first seat-bottom lock including a locking-pin receiver coupled to the foldable seat bottom for movement therewith, a locking-pin carrier coupled to the first gatefold leg unit for movement therewith and formed to include a carrier passageway that is aligned to communicate with a receiver passageway formed in the locking-pin receiver upon movement of the first gatefold leg unit to the extended position and movement of the foldable seat bottom to the unfolded use position, and a locking pin mounted for sliding movement in the carrier passageway between a withdrawn position located outside of the receiver passageway formed in the locking-pin receiver to establish an unlocked condition of the first seat-bottom retainer to free the foldable seat bottom for movement relative to the first gatefold leg unit and an inserted position arranged to extend into the receiver passageway formed in the locking-pin receiver to establish a locked condition of the first seat-bottom retainer to block movement of the foldable seat bottom relative to the first gatefold leg unit and toward the compact folded storage position alongside the backrest, wherein the first seat-bottom support brace includes a horizontal top wall arranged to lie under and face toward the foldable seat bottom upon movement of the first gatefold leg unit to the extended position and movement of the foldable seat bottom to the unfolded use position and a vertical side wall arranged to extend downwardly from the horizontal top wall and the locking-pin carrier is coupled to the vertical side wall.

4. The folding chair of claim 3, wherein the first seat-bottom support brace further includes an upright locating pin coupled to the top wall and arranged to extend upwardly into a locating-pin aperture formed in the foldable seat bottom upon movement of the first gatefold leg unit to the extended position and movement of the foldable seat bottom to the unfolded use position to provide means for aligning the receiver passageway formed in the locking-pin receiver coupled to the foldable seat bottom with the carrier passageway formed in the locking-pin carrier when the foldable seat bottom arrives at the unfolded use position and the first gatefold leg unit arrives at the extended position so that the locking pin can be moved to the inserted position to extend into the receiver passageway.

* * * * *